US010426308B2

(12) United States Patent
Stanek et al.

(10) Patent No.: US 10,426,308 B2
(45) Date of Patent: Oct. 1, 2019

(54) APPARATUS, METHOD, AND SYSTEMS FOR SECURING AN ACCESSORY TO A VACUUM APPLIANCE

(71) Applicant: EMERSON ELECTRIC CO., St. Louis, MO (US)

(72) Inventors: Terrence L. Stanek, St. Charles, MO (US); Mark Tomasiak, St. Peters, MO (US)

(73) Assignee: Emerson Electric Co., St. Louis, MO (US)

( * ) Notice: Subject to any disclaimer, the term of this patent is extended or adjusted under 35 U.S.C. 154(b) by 153 days.

(21) Appl. No.: 15/789,437

(22) Filed: Oct. 20, 2017

(65) Prior Publication Data

US 2018/0235420 A1 Aug. 23, 2018

Related U.S. Application Data

(63) Continuation-in-part of application No. 14/532,567, filed on Nov. 4, 2014, now abandoned.

(51) Int. Cl.

| | |
|---|---|
| ***A47L 9/24*** | (2006.01) |
| ***A47L 5/36*** | (2006.01) |
| ***A47L 9/00*** | (2006.01) |

(52) U.S. Cl.

CPC ..... *A47L 9/242* (2013.01); *A47L 5/365* (2013.01); *A47L 9/0027* (2013.01)

(58) Field of Classification Search

CPC ..... A47L 5/365; A47L 9/0027; A47L 9/0009; F16L 20/08; F16L 37/096

See application file for complete search history.

(56) References Cited

U.S. PATENT DOCUMENTS

| | | | | |
|---|---|---|---|---|
| 1,679,709 | A | 8/1928 | Cooper | |
| 2,245,151 | A | 6/1941 | Martinet | |
| 2,500,955 | A | 3/1950 | Martinet | |
| 4,964,189 | A | 10/1990 | Rau et al. | |
| 5,031,266 | A | 7/1991 | Tillman et al. | |
| 5,039,133 | A * | 8/1991 | Albrecht | A47L 9/02 285/298 |
| 5,042,844 | A * | 8/1991 | Iida | A47L 9/242 285/251 |
| 6,026,541 | A | 2/2000 | Bailey et al. | |
| 6,115,881 | A | 9/2000 | Hult et al. | |
| 6,702,332 | B2 | 3/2004 | Young et al. | |

(Continued)

*Primary Examiner* — Dung Van Nguyen

(74) *Attorney, Agent, or Firm* — Armstrong Teasdale LLP

(57) ABSTRACT

Described are methods, apparatuses, and systems for securing a vacuum appliance to a vacuum device including a first locking adapter that includes a tab and a second locking adapter that includes a receiving slot. The first and second adapters form an airtight seal when the tab is received by the slot by rotating one adapter relative to the other. The receiving slot can include a slot terminus to restrict rotational movement of the first adapter relative to the second. The apparatus can further include a securing slot that can secure the tab within a slot terminus such that a portion of the second locking adapter adjacent to the receiving slot is adapted to flex. Through the described rotation, the first and second adapters tighten and become rigid thus minimizing both the slippage between these two elements and the leakage between the vacuum device and any attached appliances.

20 Claims, 19 Drawing Sheets

(56) References Cited

U.S. PATENT DOCUMENTS

| | | | | |
|---|---|---|---|---|
| 7,134,694 | B2 | 11/2006 | Young et al. | |
| 2004/0124630 | A1* | 7/2004 | Jung | A47L 9/242 285/7 |
| 2004/0232695 | A1* | 11/2004 | Wirth, Jr. | F16L 37/248 285/314 |
| 2008/0184517 | A1 | 8/2008 | Phelan et al. | |
| 2015/0245753 | A1 | 9/2015 | Schuele et al. | |

* cited by examiner

APPARATUS, METHOD, AND SYSTEMS FOR SECURING AN ACCESSORY TO A VACUUM APPLIANCE

CROSS REFERENCE TO RELATED APPLICATIONS

This application is a continuation-in-part, and claims priority benefit, of U.S. application Ser. No. 14/532,567, filed Nov. 4, 2014, entitled "Apparatus, Method, and Systems for Securing an Accessory to a Vacuum Appliance", which is incorporated herein by specific reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to securing an accessory to a vacuum device or vacuum appliance, such as a vacuum cleaner. In one of the aspects, the invention relates specifically to an apparatus, wherein the apparatus is adapted to couple a first conduit to a securing adapter by rotating the first conduit with respect to the securing adapter. Through this rotation, the first conduit and the securing adapter tighten to become rigid thus minimizing both the slippage between these two elements and the leakage between the vacuum device and any attached appliance.

Description of the Related Art

Vacuum cleaners are commonly employed to remove contaminants, dirt, dust, debris, and the like from floors, furniture, and various other surfaces. Because vacuum cleaners are highly versatile tools, they are often manufactured to be compatible with various attachments, appliances, or other specialized tools to meet the specific needs of a particular operator. For example, these attachments may include brushes, squeegees, tapered nozzles, crevice tools, or the like. These attachments are often prepackaged with the vacuum cleaners themselves, or are available for purchase separately.

Because operators typically require more than one particular attachment, they are often designed to be interchangeable with a particular vacuum cleaner so that the operator can quickly switch between multiple attachments. Vacuum cleaner attachments, therefore, must incorporate an assembly mechanism in order to connect the attachment to the vacuum device. Several assembly solutions presently exist in the prior art. For example, vacuum cleaner attachments often employ a "friction-fit" assembly. Friction-fit assemblies allow an operator to attach and detach tool attachments to and from a vacuum cleaner hose or extension wand by connecting the outer perimeter of the tool attachment with the inner perimeter of a hose or conduit connected to the vacuum cleaner.

For example, U.S. Pat. No. 6,026,541 to Bailey, et al. describes a multi-purpose attachment tool for a hand-held vacuum cleaner that combines the functionality of both a crevice tool and extension wand in a single instrument. The multi-purpose attachment tool for a hand-held vacuum cleaner includes an insertion end adapted for friction-fit slidable mounting into the nozzle end of the hand-held vacuum cleaner, a nozzle end adapted for cleaning crevices and the like, and a self-supporting accordion-joint interconnecting the two ends.

Although friction-fit assemblies allow an operator to quickly attach and detach attachments to and from a vacuum cleaner, they have several drawbacks as well. For example, friction-fit assemblies can create a connection between an attachment and the vacuum cleaner that is too tight, thereby making it very difficult to remove the attachment once the operator is finished using it. Furthermore, friction-fit assemblies can become too loose, especially over time through multiple uses. When the fiction-fit assembly is too loose, the interface between the attachment and the vacuum cleaner hose can leak, resulting in a loss in suction and/or poor vacuum performance. Leakage can also result in an undesirable, high-pitched whistling sound that can cause an annoyance during the operator's use. Moreover, loose attachments, if not fitted properly, can detach altogether throughout the operator's use.

Alternatively, tool assemblies sometimes employ attachment nodes or other protrusions extending from the attachment to engage with receiving holes on a vacuum hose. For example, U.S. Patent Publication No. 2008/0184517 to Phelan, et al. discloses a vacuum appliance having a housing with an attached intake port. A plurality of attachments nodes are axially located about the intake port. An accessory with a plurality of axially located grooves selectively engage the plurality of attachment nodes to establish a locking relationship with the intake port.

Although these attachment nodes help mitigate some of the drawbacks associated with friction-fit assemblies, this solution has several drawbacks as well. For example, attachment nodes are often clumsy to handle and do not allow for the rapid attachment and detachment of vacuum attachments as compared to friction-fit assemblies. Furthermore, these attachment nodes cannot correct for tolerances that exist among various attachment tools. As a result, these assemblies will loosen during use causing a reduction in the vacuum cleaner's suction.

Other attachment solutions have been described, for example, in U.S. Pat. Nos. 6,115,881 and 7,134,694, which describe adapter devices for connecting a hose to a hose receptacle of an object, such as a wet/dry vacuum, in a locking relationship. The adapter includes a first end adapted to be fixedly attached to one of the hose receptacle or the hose and a second end having a first locking element adapted to selectively engage a second locking element to establish a locking relationship. The adapter is suitable for adapting a friction-based vacuum appliance hose connection receptacle such that it can be used with a hose-locking mechanism to selectively, securely lock a hose to the vacuum appliance. However, this approach does not correct for part tolerances that can cause loosening and air leakage in the vacuum system during operation.

What is required, therefore, is are systems, methods, and apparatuses for overcoming the problem addressed above. Accordingly, the inventions disclosed and taught herein are directed to a methods, systems, and apparatuses for securing a vacuum appliance that overcomes the problems set forth above.

BRIEF SUMMARY OF THE INVENTION

The present invention is directed to a method, system, and apparatus for securing a vacuum appliance to a vacuum device. The vacuum appliance is secured to the vacuum device through a rotating motion to produce a coupled connection that minimizes both the slippage and the leakage between the vacuum device and any attached appliances.

Described are methods, apparatuses, and systems for securing a vacuum appliance to a vacuum device including a first locking adapter that includes a tab and a second locking adapter that includes a receiving slot. The first and second adapters form an airtight seal when the tab is received by the slot by rotating one adapter relative to the other. The receiving slot can include a slot terminus to restrict rotational movement of the first adapter relative to the second. The apparatus can further include a securing slot that can secure the tab within a slot terminus such that a portion of the second locking adapter adjacent to the receiving slot is adapted to flex. Through the described rotation, the first and second adapters tighten and become rigid thus minimizing both the slippage between these two elements and the leakage between the vacuum device and any attached appliances.

The disclosure also provides an apparatus for securing a vacuum appliance to a vacuum device that can include a first locking adapter that can include a tab and a second locking adapter that can include a receiving slot. The first and second locking adapters can form an airtight seal when the tab is received by the receiving slot. The receiving slot can include a slot terminus adapted to restrict rotational movement of the first locking adapter relative to the second locking adapter.

The apparatus can further include a securing slot that can be adapted to secure the tab within a slot terminus such that a portion of the second locking adapter adjacent to the receiving slot is adapted to flex, thereby locking the tab to the receiving slot when the tab is coupled with the slot terminus. An airtight seal is formed between the first and second locking adapters by rotating one of the first and second locking adapters relative to the other, for example, by rotating the locking adapters approximately thirty (30) degrees relative to each other. Finally, the receiving slot can be ramped such that the height of the slot relative to the second locking adapter increases as the slot approaches the slot terminus.

The disclosure also provides a method for securing a vacuum appliance to a vacuum device that can include the step of providing a first locking adapter that can include a tab and the step of providing a second locking adapter that can include a receiving slot. Additionally, the method can include the step of forming an airtight seal between the first and second locking adapters when the tab is received by the receiving slot. The receiving slot can include a slot terminus adapted to restrict rotational movement of the first locking adapter relative to the second locking adapter.

The method can further include the step of providing a securing slot that can be adapted to secure the tab within a slot terminus and the step of rotating one or more of the first and second locking adapters relative to the other, for example, by rotating the locking adapters approximately thirty (30) degrees relative to each other. Finally, the receiving slot can be ramped such that the height of the slot relative to the second locking adapter increases as the slot approaches the slot terminus.

The disclosure also provides a system for securing a vacuum appliance wherein the system can include a vacuum device and an apparatus for securing a vacuum appliance to a vacuum device. The system's apparatus can include a first locking adapter that can include a tab and a second locking adapter that can include a receiving slot. The first and second locking adapters can form an airtight seal when the tab is received by the receiving slot. The receiving slot can include a slot terminus adapted to restrict rotational movement of the first locking adapter relative to the second locking adapter.

The system's apparatus can further include a securing slot that can be adapted to secure the tab within a slot terminus such that a portion of the second locking adapter adjacent to the receiving slot is adapted to flex, thereby locking the tab to the receiving slot when the tab is coupled with the slot terminus. An airtight seal is formed between the first and second locking adapters by rotating one of the first and second locking adapters relative to the other, for example, by rotating the locking adapters approximately thirty (30) degrees relative to each other. Finally, the receiving slot can be ramped such that the height of the slot relative to the second locking adapter increases as the slot approaches the slot terminus.

Described are methods, apparatuses, and systems for securing a vacuum appliance to a vacuum device including a first locking adapter that includes a tab and a second locking adapter that includes a series of flanges. The first and second adapters form an airtight seal when a tooth of the tab engages the series of flanges. Through described longitudinal movement, the first and second adapters tighten and become rigid thus minimizing both the slippage between these two elements and the leakage between the vacuum device and any attached appliances. Through described rotation, the first and second adapters may be decoupled by disengaging the tooth from the flanges.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
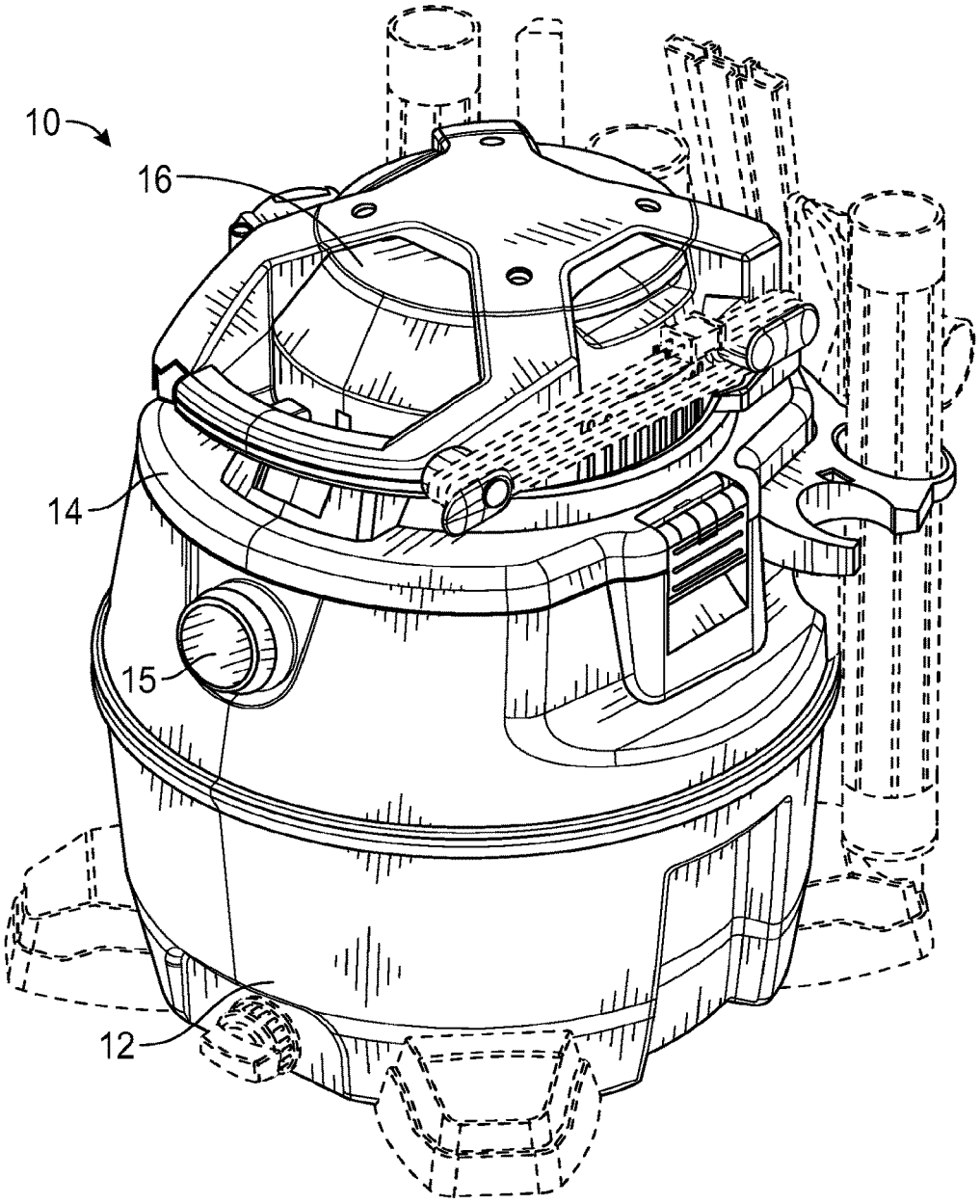
FIG. 1 illustrates a perspective view of an exemplary wet/dry vacuum cleaner connected to a connection device in accordance with an embodiment of the present invention.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The figures described above and the written description of specific structures and functions below are not presented to limit the scope of what Applicants have invented or the scope of the appended claims. Rather, the figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the figures and are not intended to limit the scope of the invention or the appended claims.

Applicants have created a method, apparatus, and system for securing a vacuum appliance to a vacuum device including a securing adapter that can be coupled to the vacuum device, a securing mechanism that can be coupled to a first conduit, and a first flange that can be coupled to a first portion of the securing mechanism by rotating the first conduit with respect to the securing adapter. The first portion of the securing mechanism can be adapted to be disposed between at least a portion of the first flange and at least a portion of a second flange. The second flange can further be adapted to align the first conduit and the securing adapter. Through the described rotation, the first conduit and the securing adapter tighten and become rigid, thus minimizing both the slippage between these two elements and the leakage between the vacuum device and any attached appliances.

Turning now to the figures, FIG. 1 illustrates a perspective view of an exemplary wet/dry vacuum cleaner connected to a connection device in accordance with an embodiment of the present invention employed on an exemplary wet/dry vacuum cleaner 10. As will be appreciated by one skilled in the art with the benefit of this disclosure, the hose securement assembly can be utilized on any application requiring a leak-free seal and a rapid connect/disconnect mechanism. As shown in FIG. 1, the wet/dry vacuum 10 comprises a collection drum 12 having a lid 14 and a powerhead assembly 16 atop the lid 14. The collection drum 12 and the lid 14 are preferably made of injection-molded plastic, such as polypropylene or the like, in accordance with conventional practice.

Figure 2:
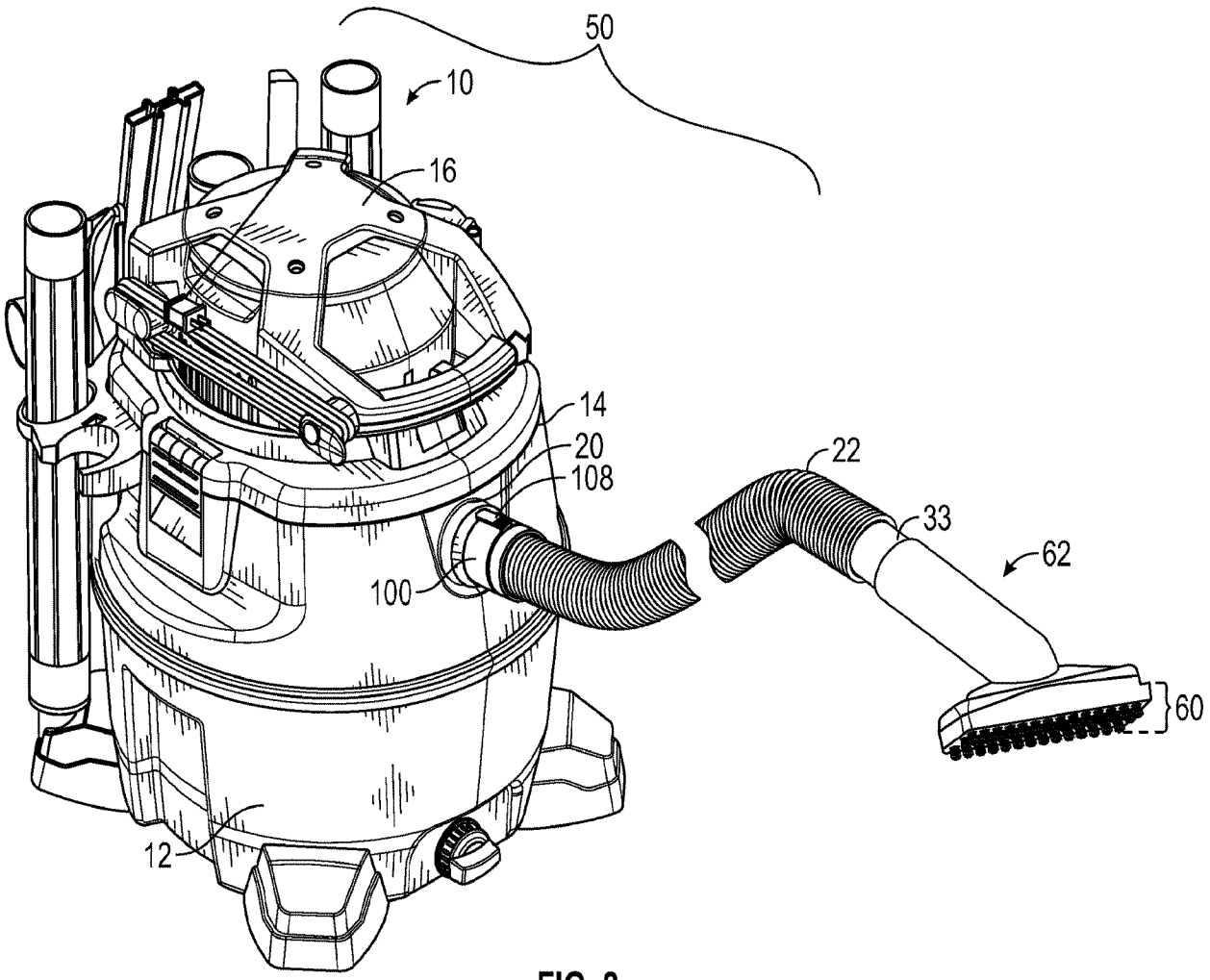
FIG. 2 illustrates an exemplary vacuum system in accordance with embodiments of the present invention.

In accordance with the figure, an air inlet port 15 is defined in a sidewall of the collection drum 12, lid 14, although alternatively, the air inlet port may be defined in the lid or the powerhead assembly 16. The powerhead assembly 16 houses a motor and impeller assembly (not shown), and has defined therein an air exhaust or outlet port 18. With reference to FIG. 2, a hose connection/securement assembly 100 is locked onto a first connection receptacle 20 that is mounted on the inlet port 15 of the wet/dry vacuum 10 to attach a conduit 22, such as a hose, to the wet/dry vacuum 10. A release element 108 positively locks the connection member 100 to the wet/dry vacuum 10. The first connection receptacle 20 can be removably mounted to the wet/dry vacuum 10, or can be an integral part of it, as appropriate. The powerhead assembly 16 is operable to create a suction within the collection drum 12, such that debris and/or liquid is drawn into the collection drum 12 through the hose 22, which is attached to the inlet port 15 via the hose securement assembly 100 and the first connection receptacle 20.

Figure 8A:
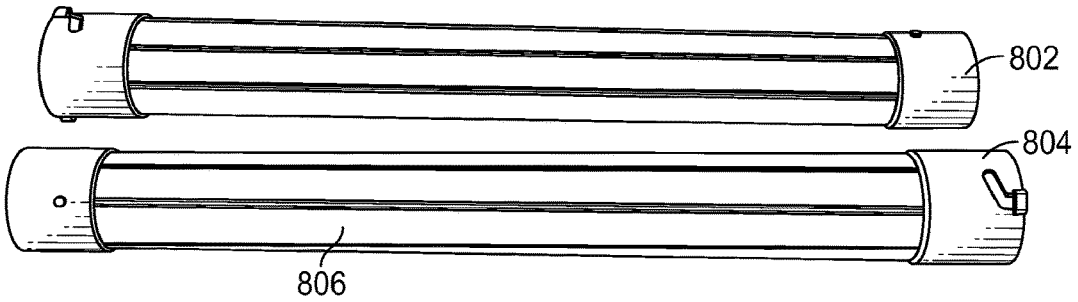
FIG. 8A a perspective view of a fourth embodiment of an apparatus for securing a vacuum hose or accessory to a vacuum device in accordance with certain aspects of the present invention.

The assembly shown in FIG. 2 illustrates an exemplary vacuum system in accordance with embodiments of the present invention. In addition to the elements described above with reference to FIG. 1, system 50 can include a second connection receptacle 33 that can be used to couple conduit 22 with accessory 62. Accessory 62 can include one or more various vacuum accessories such wands, brushes, nozzles, or the like. For example, in FIG. 2, accessory 62 can include brush 60, although other vacuum accessories are contemplated as well. In one embodiment, second connection receptacle 33 can be replaced with one or more of the apparatuses for securing a vacuum appliance to a vacuum device as described below. For example, in one embodiment, second connection receptacle 33 can be replaced with apparatus 800 as described in greater detail with reference to FIGS. 8A-8F. In another embodiment, second connection receptacle 33 can be replaced with apparatus 900 as described in greater detail with reference to FIGS. 9A-9D. In yet another embodiment, an apparatus in accordance with the present disclosure (e.g., apparatus 800, apparatus 900, etc.) can be coupled to a separate conduit (such as, for example, conduit 806 as illustrated in FIG. 8A) and the conduit 806 can be coupled to second connection receptacle 33.

Figure 3A:
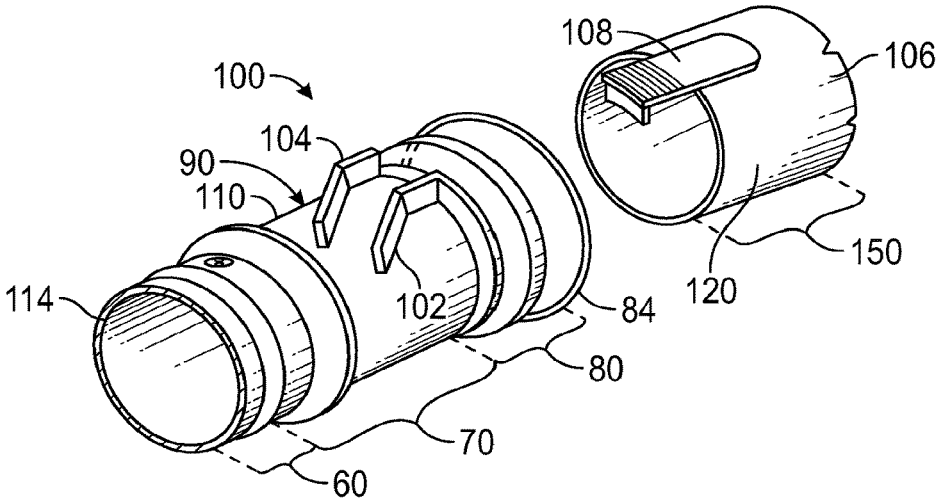
FIG. 3A illustrates a perspective view of a first embodiment of an apparatus for securing a vacuum hose or accessory to a vacuum device in accordance with certain aspects of the present invention.
Figure 3B:
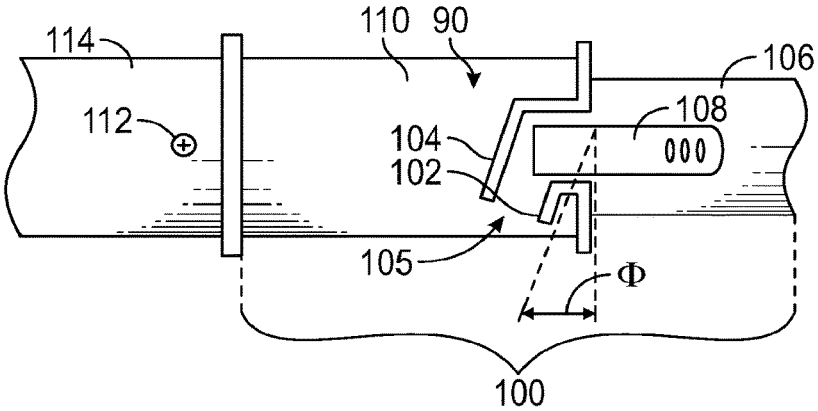
FIG. 3B illustrates a top view of the embodiment of FIG. 3A.
Figure 3C:
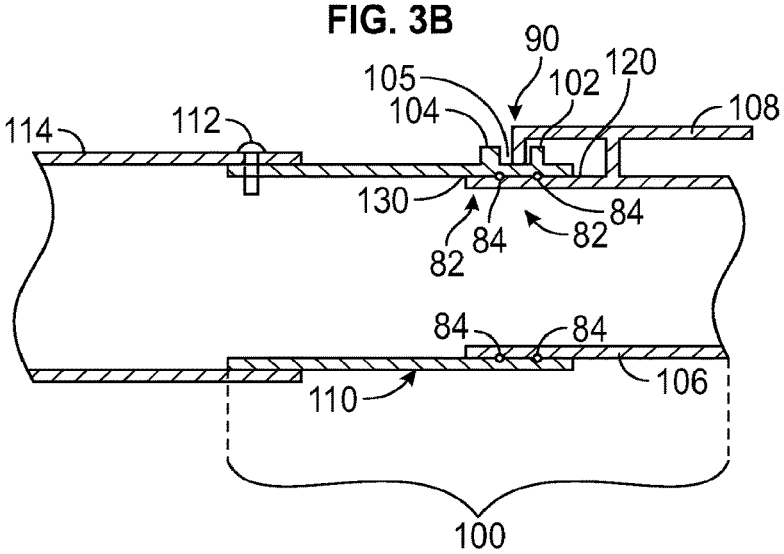
FIG. 3C illustrates a cross-sectional side view of the embodiment of FIG. 3A

With continued reference to the figures, FIG. 3A illustrates a perspective view of a first embodiment of an apparatus for securing a vacuum hose or accessory to a vacuum device in accordance with certain aspects of the present invention. FIG. 3B illustrates a top view of the embodiment of FIG. 3A. FIG. 3C illustrates a cross-sectional side view of the embodiment of FIG. 3A. These figures will be described in conjunction with each other.

FIG. 3A illustrates a perspective view of an embodiment of the securing assembly or apparatus, 100, in accordance with the present disclosure. Securing assembly 100 includes a hose end 60, an opposite and spaced apart vacuum end 80, and a main body 70 intermediate between the hose end and the vacuum end 80. In the particular embodiment illustrated in FIG. 3A, the vacuum end 80 has a larger outside diameter than the main body 70, and is adapted to have one or more sealing members removably mounted thereto. The inside diameter of the vacuum end 80 and the main body 70 is approximately uniform. Additionally, the vacuum end 80 of the hose securing assembly may optionally further define one or more grooves 82, which are adapted to have seated therein a sealing member, such as an O-ring 84 as shown in the embodiment of FIG. 3A, 3B, and 3C, although this may alternatively and equivalently be a sealing member integrally formed in the vacuum end 80.

Such an integrally formed sealing member would have a diameter generally greater than the diameter of the vacuum end 80 so as to form a friction-type seal with an internal surface of an appropriate sized receptacle when the vacuum end 80 is inserted therein, such as connecting receptacle 150 that is adapted to have the vacuum end 80 of the connection/securing assembly 100 inserted therein. As will be discussed in more detail below, the connecting receptacle 150 includes the securing element 108. Moreover, such a sealing member may have a diameter greater than the inside diameter of a receptacle size for receiving vacuum end 80, and be formed in a manner so as to allow the sealing member to deflect when the vacuum end 80 is inserted into the receptacle. The securing assembly 100 may be made of formed (molded) or extruded plastic, such as polypropylene, polyethylene, or any other appropriate thermoplastic resin or polymeric material.

The securing assembly 100 further defines a shaped channel 90 as shown in FIG. 3A and 3B. FIG. 3C illustrates a side view of the assembly 100, including detail of the release element 108 made to fit the channel 90.

Figure 6A:
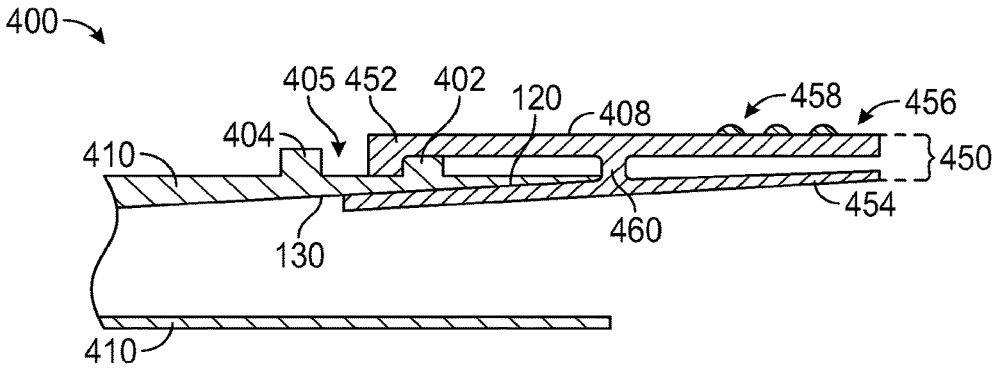
FIG. 6A illustrates a cross-sectional side view of the first embodiment of an apparatus for securing a vacuum hose or appliance to a vacuum cleaner in a locked position.
Figure 6B:
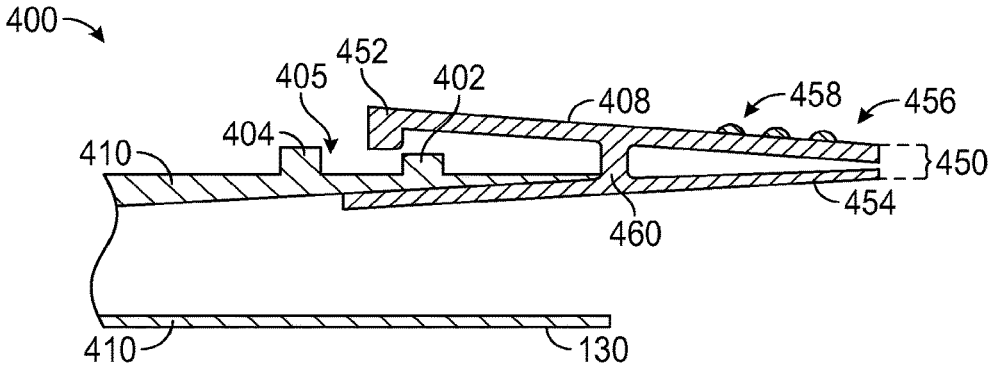
FIG. 6B illustrates a cross-sectional side view of the first embodiment of an apparatus for securing a vacuum hose or appliance to a vacuum cleaner in an unlocked position.

The channel 90 on securing apparatus 100 includes a first flange 102, a second flange 104, and a first conduit or channel 105 formed by and between the first and second flanges. That is, the first flange 102 and the second flange 104 work in conjunction with each other form a first channel 105 therebetween. A first conduit 106 can be coupled to a release element 108. The release element 108 can further be coupled to a securing mechanism (as shown in FIGS. 6A and 6B). In the alternative, the securing mechanism (detailed in FIGS. 6A and 6B) can include the release element 108. The first conduit 106 can further be coupled to a securing adapter 110. The securing adapter 110 can be coupled to a second conduit 114 with a fastener 112 or other appropriate securing means. Alternatively, the securing adapter 110 can be integrally formed or molded with the second conduit 114.

With continued reference to FIG. 3B, the first flange 102 can be coupled to an external surface of the securing adapter 110, or it can be further formed as part of a single, unitary, or monolithic structure with the securing adapter 110. The first flange 102 can include any projecting fin, collar, lip, ridge, protrusion, or the like extending outwardly from and generally perpendicular to an outer surface of the securing adapter 110. In an exemplary and non-limiting illustrative embodiment, the first flange 102 can include a ramp-like structure that extends along the outer circumference of the securing adapter 110. In this example, the first flange 102 can extend away from a terminating edge of the securing adapter 110 at a constant angle such that the first flange 102 forms a generally helix-shaped pattern along the outer perimeter of the securing adapter 110 (in a counter-clockwise configuration). In this example, the first flange 102 can form a thread-like structure around at least a portion of the securing adapter's 110 outer perimeter.

The angle in which the first flange 102 extends away from a terminating edge 107 of the securing adapter 110 can vary depending on a particular application. In FIG. 3B, this angle is represented by Φ. For example, a smaller angle (e.g., thirty degrees as measured clockwise from the terminating edge of the first conduit towards the second conduit) will result in a more gradually extending flange as compared to one configured at a sixty-degree angle. The larger the angle, the more quickly the first conduit 106 can tighten with respect to the securing adapter 110 when it is rotated with respect to the securing adapter 110. In one example, the first conduit 106 can be tightened with respect to the securing adapter 110 by rotating the first conduit 106 in a counter-clockwise direction with respect to the securing adapter 110.

In the embodiment illustrated in FIG. 3B, the angle Φ can vary from about zero degrees (0°) to about ninety degrees (90°), inclusive. In another embodiment, the positions of the first flange 102 and the second flange 104 can be interchanged. In such an embodiment, the first flange 102 can form a helix-shaped pattern along the outer perimeter of the securing adapter 110 in a clockwise configuration. In this configuration, the angle Φ, as shown in FIG. 3B, can vary between ninety degrees (90°) and one hundred and eighty degrees (180°), inclusive. Typically, the smaller the angle, the more quickly the first conduit 106 can tighten with respect to the securing adapter 110. In this example, the first conduit 106 can be tightened with respect to the securing adapter 110 by rotating the first conduit 106 in a clockwise direction with respect to the securing adapter 110.

The length of the first flange 102 and the second flange 104 can vary depending upon the angle Φ. For example, the length of the first flange 102 and the second flange 104 can be longer for smaller angles Φ than for larger angles Φ. This is because larger angles require a user to rotate the first conduit 106 fewer degrees in order for the release element 108 to couple to the first flange 102.

The second flange 104 can be coupled to an external surface of the securing adapter 110 or it can be further formed as part of a single, unitary, or monolithic structure with the securing adapter 110. The second flange 104 can include any projecting fin, collar, lip, ridge, protrusion, or the like extending outwardly from an outer surface of the securing adapter 110. In an exemplary and non-limiting illustrative embodiment, the second flange 104 can include a ramp-like structure that extends along the outer circumference of the securing adapter 110. In this example, the second flange 104 can extend away from a terminating edge of the securing adapter 110 at a constant angle such that the second flange 104 forms a helix-shaped pattern along the outer perimeter of the securing adapter 110 (in a counter-clockwise configuration). In this example, the second flange 104 can form a thread-like structure around at least a portion of the securing adapter's 110 outer perimeter so that it is substantially parallel with respect to the first flange 102.

The second flange 104 can further act as a guiding means to facilitate an operator in aligning the release element 108 in the first channel 105. More specifically, the second flange 104 can serve as a visual cue for the operator to properly align the first conduit 106 with the securing adapter 110 when attempting to couple the first conduit 106 with the securing adapter 110. In another embodiment, the second flange 104 can be omitted altogether.

The first channel 105 can include any path, pathway, groove, slot, slit, or the like disposed between the first flange 102 and the second flange 104 capable of receiving the securing element 452 (as shown in FIGS. 6A and 6B). For example, the first channel 105 can include a portion of the outer perimeter that lies between the first conduit 102 and the second conduit 104. Alternatively, the first channel 105 can include a separate component coupled to an external surface of the securing adapter 110 or it can be further formed as part of a single, unitary, or monolithic structure with the securing adapter 110 with an increasing thickness as measured from the inner perimeter of the securing adapter 110 to the outer perimeter of the securing adapter 110. For example, the thickness of the first channel 105 can be smaller near the edge of the securing adapter 110 adjacent to the first conduit 106 and larger towards the edge of the securing adapter 110 adjacent to the second conduit 114. In this configuration, the securing element 452 (as shown in FIGS. 6A and 6B) can gradually tighten against the channel 105, the first flange 102, or both as the first conduit 106 is coupled with, and rotated with respect to, the securing adapter 110.

The width of the first channel 105, as measured as the distance between the first flange 102 and the second flange 104, can vary depending on the angle Φ, the size of the securing element 452 (as shown in FIGS. 6A and 6B), or both. The width of the first channel 105 can further affect the amount of rotation required in order to secure the first conduit 106 with the securing adapter 110. For example, a smaller width requires less rotation of the first conduit 106 with respect to the securing adapter 110 to couple the securing element 452 (as shown in FIGS. 6A and 6B) to the first flange 102.

The first conduit 106 can include any tube, pipe, hose, channel, duct, pathway, passage, route, or any other fluid communication means for air or any other gas or gaseous-like material to flow from a first portion of the first conduit 106 to another portion of the first conduit 106. In an exemplary and non-limiting illustrative embodiment, the first conduit 106 can include a vacuum appliance 62 (as shown in FIG. 2), such as an attachment wand, or other tube-like structure for extending the reach of a vacuum device 10 (as shown in FIG. 2). Alternatively, the first conduit 106 can include other vacuum appliances or extensions such as brushes, squeegees, tapered nozzles, crevice tools, or the like. As a further alternative, the first conduit 106 can serve as an interface between the securing adapter 110 and a vacuum appliance 62 (as shown in FIG. 2), attachment wand, or the like. In this final example, the first conduit 106 can be adapted for releasable coupling to, or decoupling from, one or more vacuum device wands, attachments, or a vacuum appliance 62 (as shown in FIG. 2) such as brushes, squeegees, tapered nozzles, crevice tools, or the like.

The release element 108 can include any connector, fastener, clip, clasp, clamp, catch, or the like for securing the first conduit 106 to the securing adapter 110. For example, the release element 108 can include a connector that is coupled to the first conduit 106. In another example, the release element 108 can be formed as a single, unitary, or monolithic structure with the first conduit 106. The release element 108 can include at least a portion which extends beyond the edge of the first conduit 106 that can be coupled to the securing adapter 110. The securing adapter and its constituent components are described in greater detail in conjunction with FIG. 6A and 6B.

The securing adapter 110 can include any connector, coupler, coupling, fastener, joint, junction, or intermediary device for establishing fluid communication between a vacuum device (not shown) and the first conduit 106. For example, the securing adapter 110 can include a separate adapter that is capable of coupling with the second conduit 114. The second conduit 114 can further be coupled to a vacuum device (not shown). In this embodiment, the securing adapter 110 can be releasably coupled to, and decoupled from, the second conduit 114. Alternatively, the securing adapter 110 may be eliminated entirely such that the first flange 102, the second flange 104, and the channel 105 are formed as part of the second conduit 114. In another example, the securing adapter 110 can be a permanently coupled with the second conduit 114. In this example, the securing adapter 110 can be formed as a single, unitary, or monolithic structure with the second conduit 114. Furthermore, in this embodiment, the fastener 112 can be omitted because there would be no need to attach and detach the securing adapter 110 to and from the second conduit 114.

The fastener 112 can include any screw, snap, hook, button, catch, clasp, bolt, clip, or other means for coupling and securing the securing adapter 110 to the second conduit 114. In one example, the fastener 112 can include a screw for coupling the securing adapter 110 to the second conduit 114 through one or more cavities (not shown), such as a hole, through a portion of each of these two components. In this embodiment, the securing adapter 110 can be coupled to the second conduit 114 so that the cavities formed in each of these two components are aligned. Once aligned, the fastener 112 can be coupled to the securing adapter 110 and the second conduit 114. In an alternative embodiment, the fastener 112 can be used couple the securing adapter 110 directly to a vacuum device (not shown). In this embodiment, the second conduit 114 can be eliminated entirely.

The second conduit 114 can include any tube, pipe, hose, channel, duct, pathway, passage, route, or any other fluid communication means for air or any other gas or gaseous-like material to flow from a first portion of the second conduit 114 to another portion of the second conduit 114. In an exemplary and non-limiting illustrative embodiment, the second conduit 114 can include a vacuum hose for coupling the securing adapter 110 to a vacuum device (not shown). Alternatively, the second conduit 114 can be omitted altogether. In this example, the securing adapter 110 can be coupled directly to a vacuum device (not shown).

FIG. 3C illustrates a side view of the first embodiment of an apparatus for securing a vacuum appliance to a vacuum device. As described with regard to FIGS. 3A and 3B above, the apparatus 100 can include a first flange 102, a second flange 104, and a first conduit 106. The first flange 102 and the second flange 104 can form a first channel 105. The first conduit 106 can be coupled to a release element 108. The release element 108 can further be coupled to a securing mechanism 450 (as shown in FIGS. 6A and 6B), or be formed as a constituent element of the securing mechanism 450. The first conduit 106 can further be coupled to a securing adapter 110. The securing adapter 110 can be coupled to a second conduit 114.

Figure 4A:
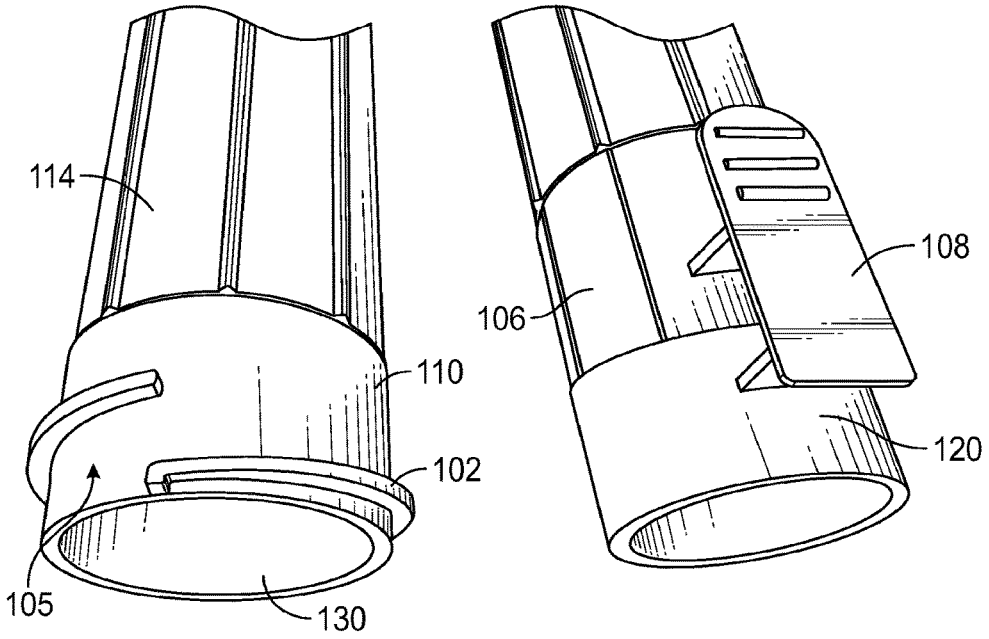
FIG. 4A illustrates a perspective view of a second embodiment of an apparatus for securing a vacuum hose or accessory to a vacuum device in a decoupled configuration.
Figure 4B:
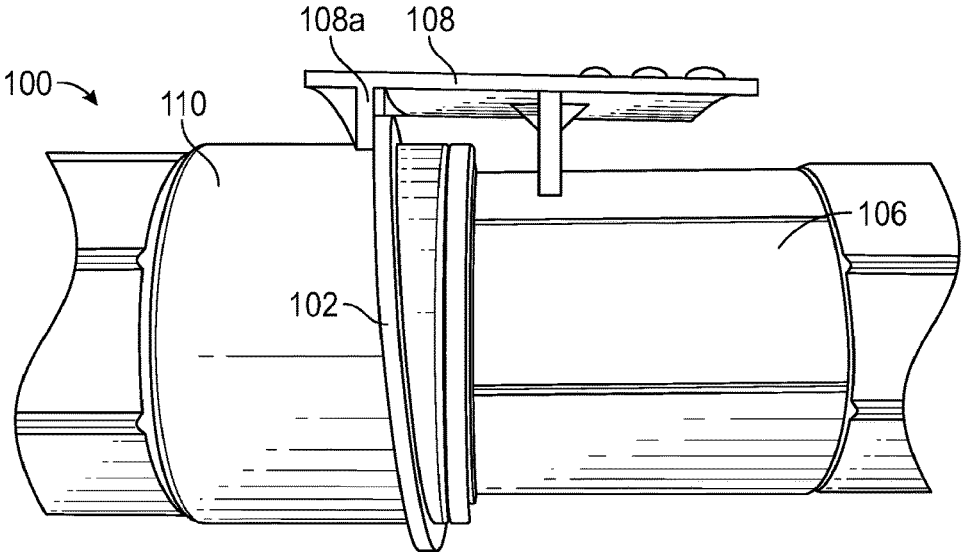
FIG. 4B illustrates a perspective view of the embodiment of FIG. 4A in a coupled configuration.

FIG. 4A illustrates a perspective view of a second embodiment of an apparatus for securing a vacuum hose or accessory to a vacuum device in a decoupled configuration. FIG. 4B illustrates a perspective view of the embodiment of FIG. 4A in a coupled configuration. These figures will be described in conjunction with one another.

Securing apparatus 100 is a variation of securing apparatus 100 illustrated in FIGS. 3A and 3B with the omission of one or more of the first and second flanges 102 and 104, respectively. For example, apparatus 100 can include one and only one flange (e.g., first flange 102) disposed around part of, or the entire, outer surface of securing adapter 110. In the example of a cylindrical securing adapter as illustrated in these figures, first flange 102 can be disposed in a spiral or helix configuration such that a first channel 105 can be formed between the inner portions of flange 102. In this configuration, first channel 105 can serve as a guide for a portion 108*a* of release element 108 to couple with first flange 102. Likewise, flange 102 can be designed to create a friction taper fit between two or more vacuum elements to seal the same.

In order to couple securing adapter 110 to first conduit 106, an operator can align first portion 108*a* of release element 108 with the inner surface of first flange 102 and within first channel 105. By rotating first conduit 106 the direction of first flange 102, first conduit 106 will begin to be threaded to securing adapter 110 as first portion 108*a* of release element 108 travels along first flange 102 thereby locking it in place. Because one or more of first conduit 106 and securing adapter 110 can be coupled to second conduit 114, the rotational tightening as described above can help to form an airtight seal between two or more elements of a vacuum apparatus (such as hoses, nozzles, and other appliances or the like). Once coupled, first conduit 106 and securing adapter 110 can be decoupled either by reversing the rotation between the two elements as described above, or, in the alternative, release element 108 can be employed as a quick release tab as described in greater detail below in conjunction with FIGS. 6A and 6B.

While FIG. 4A shows the first flange 102 wrapping around 360 degrees of the securing adapter 110, other degrees of rotation may be used, such as 180 degrees. For example, rather than rotating the first conduit 106 about the securing adapter 110 360 degrees to reach the end of the first flange 102, thereby fully coupling the securing adapter 110 to the first conduit 106, the first flange 102 may be angled such that the securing adapter 110 is fully coupled to the first conduit 106 with only 180 degrees of relative rotation. Through experimentation, the inventors has discovered that between 120 and 360 degrees of rotation is preferred to fully couple the securing adapter 110 to the first conduit 106.

Figure 5:
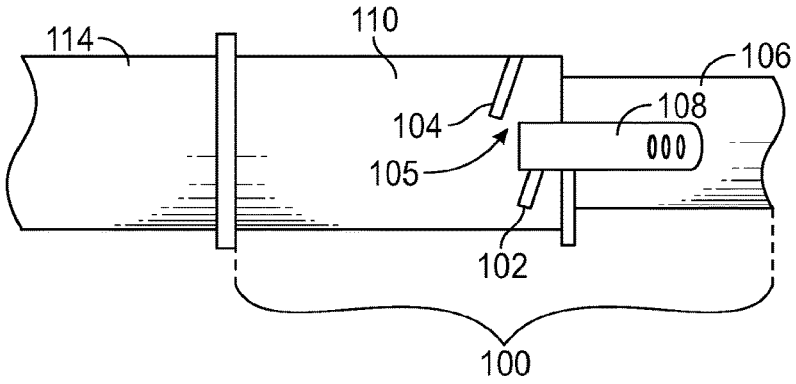
FIG. 5 illustrates a top view of a third embodiment of an apparatus for securing a vacuum hose or accessory to a vacuum device.

FIG. 5 illustrates a top view of a third embodiment of an apparatus for securing a vacuum hose or accessory to a vacuum device. The first conduit 106 is coupled to the securing adapter 110 after being rotated counter-clockwise with respect to the securing adapter 110. In this embodiment, a portion of the release element 108 is coupled to the first flange 102 thus securing the first conduit 106 to the securing adapter 110. Once coupled and secured, the first conduit 106 can tighten against the securing adapter 110 thus forming a rigid connection between these two components. This rigid connection helps minimize both the slippage between these two elements and the leakage between a vacuum device (not shown) and any attached appliances (not shown). This is because the rotational tightening as described can correct for tolerances in the parts so that they cannot become loose throughout their operation. In order to decouple the first conduit 106 from the securing adapter 110, the first conduit 106 can be rotated in a clockwise direction with respect to the securing adapter 110. Alternatively, the release element 108 can be decoupled from the first flange 102 by applying a force to a portion of the release element 108 in the direction of the first conduit 106. For example, this portion can include the securing element 452 (as shown in FIGS. 6A and 6B). This decoupling is described in greater detail in connection with FIGS. 6A and 6B.

With regard to FIGS. 6A and 6B, several of the elements depicted in these figures correspond to the elements depicted in FIG. 3A-3C. More specifically, two elements correspond between the figures when the final two digits of a labeled element in FIGS. 6A and 6B are the same as the final two digits of a labeled element in FIG. 3A-3C. For example, the first flange 402 depicted in FIG. 6A corresponds to the first flange 102 of FIG. 3A. When two elements in the figures correspond, the embodiments, examples, and descriptions of each of the 100-series elements apply to their corresponding 400-series elements as well. Any exceptions to this general rule are noted below.

FIG. 6A illustrates a cross-sectional side view of the first embodiment of an apparatus for securing a vacuum appliance to a vacuum device in a locked position. FIG. 6B illustrates a cross-sectional side view of the first embodiment of an apparatus for securing a vacuum appliance to a vacuum device in an unlocked position. These figures will be described in conjunction with one another.

The apparatus 400 can include a first flange 402 and a second flange 404. The first flange 402 and the second flange 404 can form a first channel 405. The apparatus 400 can include a securing adapter 410 that can be coupled to a release element 408. The apparatus 400 can further include a securing mechanism 450 that can further include a securing element 452, a bottom portion 454, and a top portion 456. The securing mechanism 450 can further include a gripping element 458 and a support element 460.

The securing element 452 can include any connector, fastener, clip, clasp, clamp, catch, or the like for securing the first conduit (not shown) to the securing adapter 410. In an exemplary and non-limiting illustrative embodiment, the securing element 452 can include a clamp-like structure that is capable of coupling to the first flange 402 such that a portion of the securing element 452 is disposed within the first channel 405 formed between the first flange 402 and the second flange 404. In this embodiment, the securing element 452 is adapted to secure and lock the securing mechanism 450 in place to prevent it from loosening or decoupling during operation. When the securing mechanism 450 is further coupled to the first conduit (not shown), the securing mechanism 450, while locked in place in the manner described above, can prevent the first conduit (not shown) from loosening or decoupling during its operation as well.

In order to decouple the securing element 452 from the first flange 402, an operator can rotate the first conduit (not shown) coupled to the securing mechanism 450 in the opposite direction from its initial rotation. For example, in the embodiment illustrated in FIGS. 3A-3C, the first conduit 106 can be rotated in a counter-clockwise direction with respect to the securing adapter 110 in order to couple the release element 108 with the first flange 102. In order to decouple the first conduit 106 from the first flange 102 in this example, the first conduit 106 can be rotated in a clockwise direction with respect to the securing adapter 110 in order to position the securing element 452 (as shown in FIGS. 6A and 6B) such that is disposed between the first flange 102 and the second flange 104. Once disposed between these two flanges, the first conduit 106 may be decoupled from the securing adapter 110.

Alternatively (referring back to FIGS. 6A and 6B), the operator can apply a downward force on the top portion 456 of the securing mechanism 450 towards the direction of the bottom portion 454 of the securing mechanism 450. By doing so, a portion of the securing mechanism 450 can pivot at the support element 460 thereby raising the securing element 452 and a portion of the release element 408, thus decoupling it from the first flange 402. The result of this movement is illustrated in FIG. 6B. Once decoupled, an operator can apply a force to the first conduit (not shown) in a direction opposite to the securing adapter 410 thereby decoupling the first conduit (not shown) from the securing adapter 410.

In an exemplary and non-limiting illustrative embodiment, an operator can grip the first conduit (not shown) with his hands such that his thumb is placed over the top portion 456 of the securing mechanism 450. In this example, the operator's thumb can be coupled to the gripping element 458 to prevent the operator's thumb from slipping along the surface of the securing mechanism 450. For example, the gripping element 458 can prevent slippage by way of sheering along the outer surface of the securing mechanism 450. The gripping element 458 can include one or more knobs, bulges, lumps, projections, humps, protrusions, or other protuberances extending outwardly from the top portion 456 of the securing mechanism 450.

The support element 460 can include any fulcrum, hinge, swivel, pivot, or support for providing leverage between the top portion 456 of the securing mechanism 450 and the securing element 452. In an exemplary and non-limiting illustrative embodiment, the support element 460 can include a piece of material coupled between the top portion 456 and the bottom portion 464 of the securing mechanism 450. Alternatively, the support element 460 can be formed as a single, unitary, or monolithic structure with the other remaining elements of the securing mechanism 450.

Figure 7:
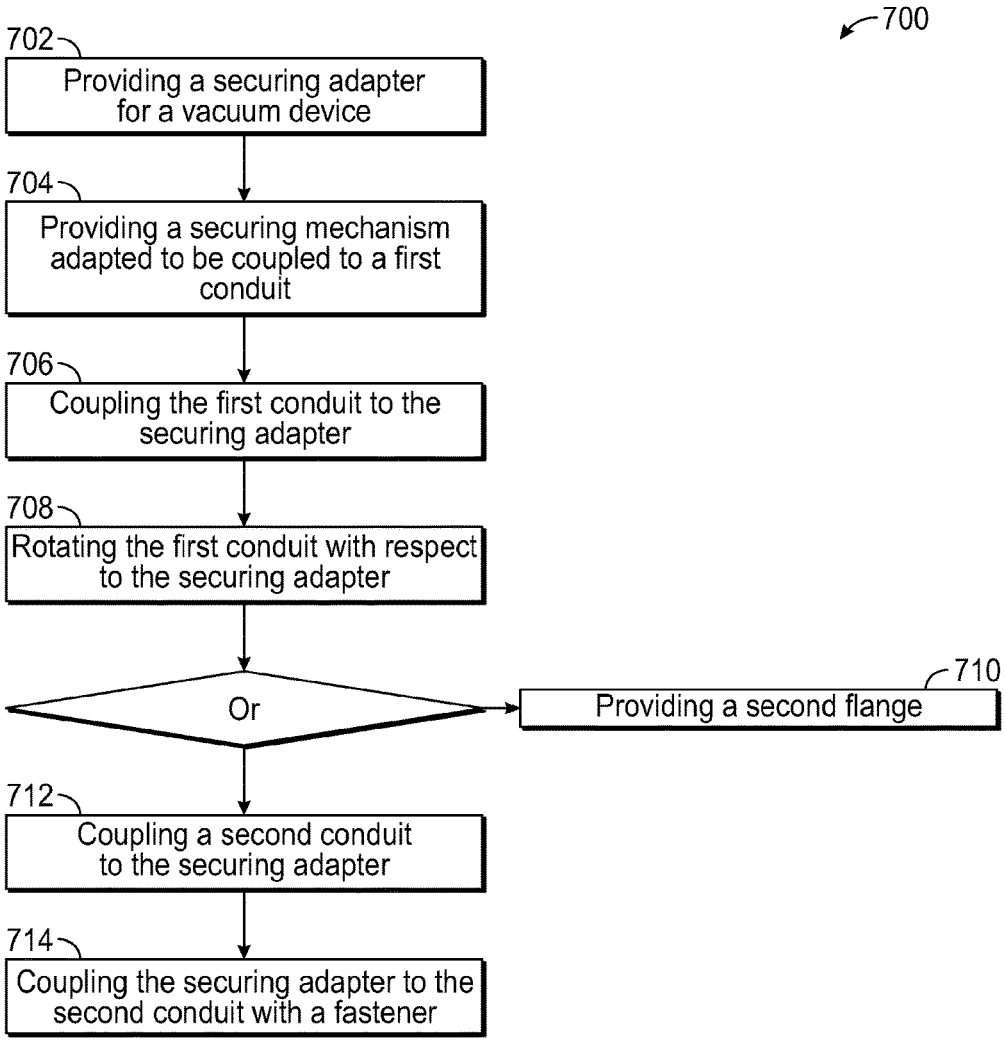
FIG. 7 illustrates a general flow diagram depicting a first embodiment of an exemplary method of using devices of the present invention.

FIG. 7 illustrates a general flow diagram depicting an exemplary method for securing a vacuum appliance to a vacuum device. The method 700 can include the step 702 of providing a securing adapter for a vacuum device and the step 704 of providing a securing mechanism adapted to be coupled to a first conduit. The method 700 can further include the step 706 of coupling the first conduit to the securing adapter and the step 708 of rotating the first conduit with respect to the securing adapter. The method 700 can further include the step 710 of providing a second flange, the step 712 of coupling a second conduit to the securing adapter, and the step 714 of coupling the securing adapter to the second conduit with a fastener.

The step 702 of providing a securing adapter for a vacuum device can include providing an adapter that is capable of being releaseably attached to, or detached from, a vacuum device, a first conduit, a second conduit, or any combination thereof. The step 704 of providing a securing mechanism adapted to be coupled to a first conduit can include coupling the securing mechanism to a top portion of a first conduit. Alternatively, the step 704 of providing a securing mechanism can include providing a securing mechanism formed as a single, unitary, or monolithic structure with the first conduit. The step 706 of coupling the first conduit to the securing adapter can include coupling the first conduit to the securing adapter such that it can be releaseably attached to, or detached from, the securing adapter. For example, the step 706 can include inserting the first conduit so that the outer perimeter of the first conduit is coupled to a portion of the inner perimeter of the securing adapter.

The step 708 of rotating the first conduit with respect to the securing adapter can include rotating the first conduit in a counter-clockwise direction with respect to the securing adapter in order to couple the release element with the first flange. The step 708 of rotating the first conduit with respect to the securing adapter can further include rotating the first conduit in the opposite direction (e.g., clockwise) in order to decouple the first conduit from the securing adapter. In an alternative embodiment, the directions of rotation can be reversed (i.e., a clockwise rotational direction to couple the first conduit to the securing adapter) and a counter-clockwise rotational direction to decouple the first conduit from the securing adapter.

The step 710 of providing a second flange can include providing a second flange that is substantially parallel with respect to the first flange. For example, the second flange can be disposed at a constant angle such that the second flange forms a helix-shaped pattern along the outer perimeter of the securing adapter. The step 712 of coupling a second conduit to the securing adapter can include coupling the second conduit to the securing adapter such that it can be releaseably attached to, or detached from, the securing adapter. For example, the step 712 can include inserting the securing adapter so that the outer perimeter of the securing adapter is coupled to the inner perimeter of the second conduit. The step 714 of coupling the securing adapter to the second conduit with a fastener can include coupling the securing adapter to the second conduit through one or more cavities, such as a hole, through a portion of each of these two components. For example, the step 714 can include coupling the securing adapter to the second conduit so that the cavities formed in each of these two components are aligned. Once aligned, the fastener may be coupled to the securing adapter and the second conduit.

Figure 8B:
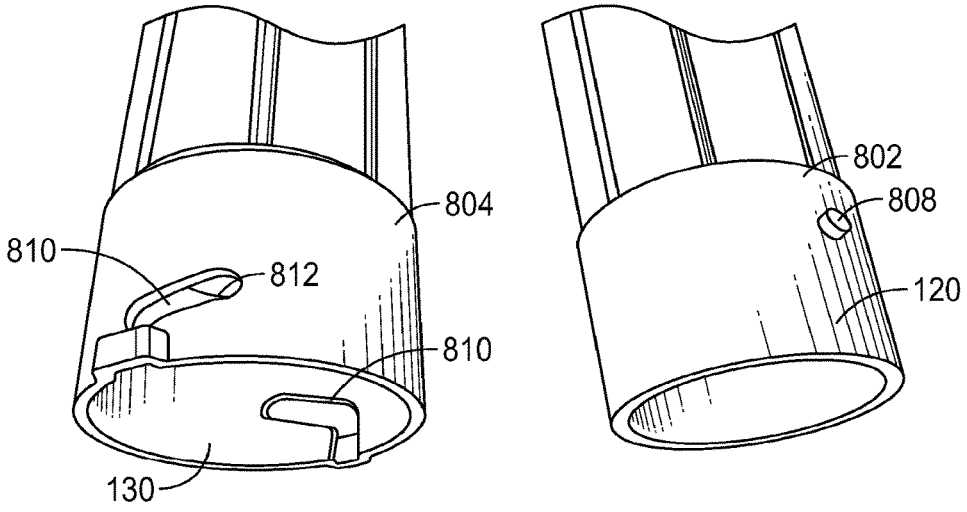
FIG. 8B illustrates a perspective view of the embodiment of FIG. 8A in a decoupled configuration.
Figure 8C:
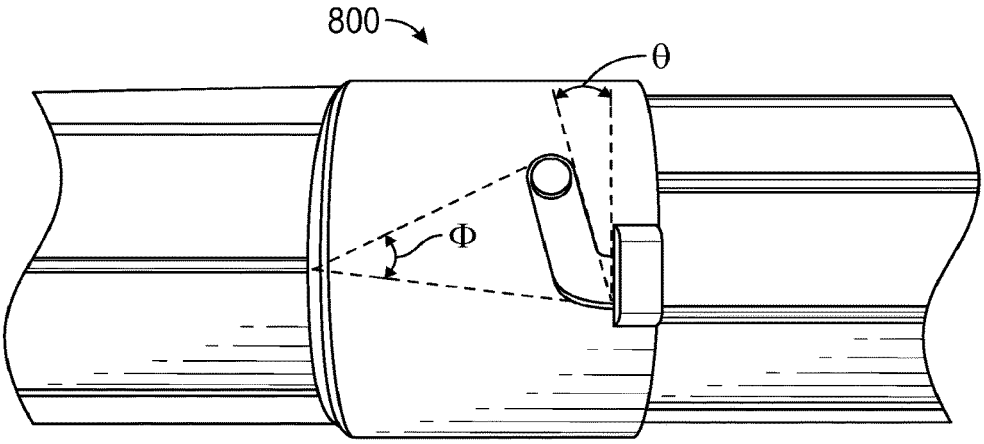
FIG. 8C illustrates a perspective view of the embodiment of FIG. 8A in a coupled configuration.
Figure 8D:
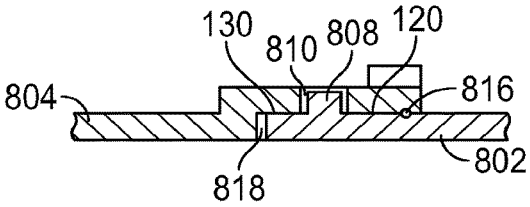
FIG. 8D illustrates a partial cross-sectional side view of the embodiment of FIG. 8A in a coupled configuration.
Figure 8E:
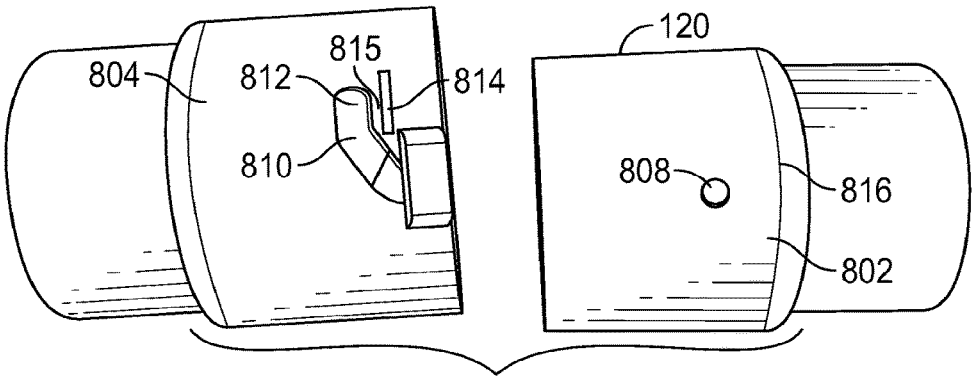
FIG. 8E illustrates a perspective view of a fifth embodiment of an apparatus for securing a vacuum hose or accessory to a vacuum device in a decoupled configuration.
Figure 8F:
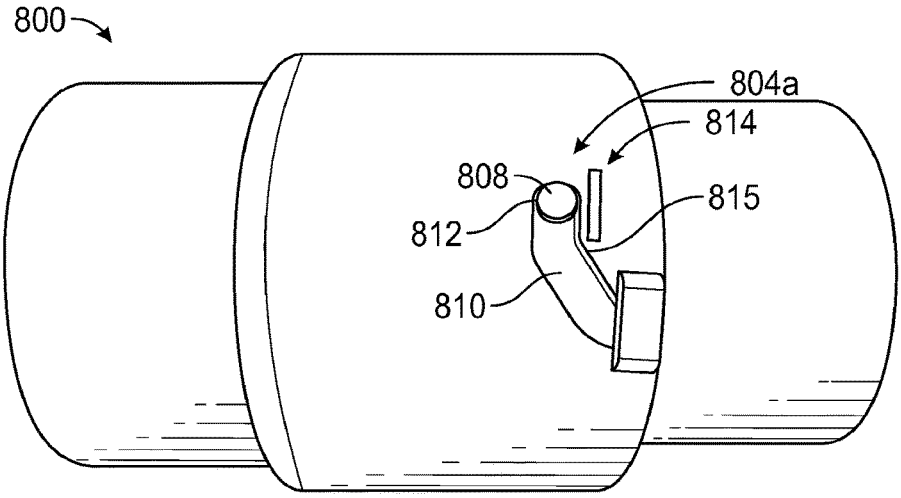
FIG. 8F illustrates a perspective view of the embodiment of FIG. 8E in a coupled configuration.

FIG. 8A a perspective view of a fourth embodiment of an apparatus for securing a vacuum hose or accessory to a vacuum device in accordance with certain aspects of the present invention. FIG. 8B illustrates a perspective view of the embodiment of FIG. 8A in a decoupled configuration. FIG. 8C illustrates a perspective view of the embodiment of FIG. 8A in a coupled configuration. FIG. 8D illustrates a partial cross-sectional view of the embodiment of FIG. 8A in a coupled configuration. FIG. 8E illustrates a perspective view of a fifth embodiment of an apparatus for securing a vacuum hose or accessory to a vacuum device in a decoupled configuration. FIG. 8F illustrates a perspective view of the embodiment of FIG. 8E in a coupled configuration. These figures will be described in conjunction with one another.

Figure 8G:
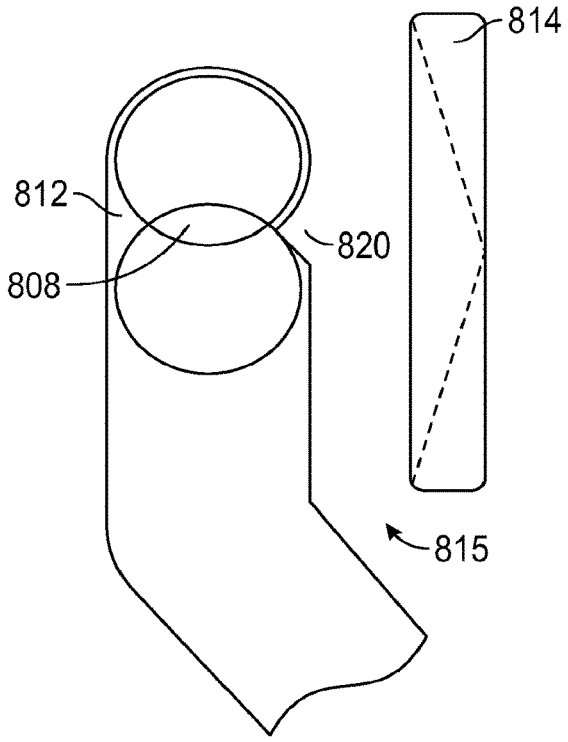
FIGS. 8G-8K and 8O illustrate various close-up views of a receiving slot, a securing slot, and a cam of the embodiment of FIG. 8E.
Figure 8H:
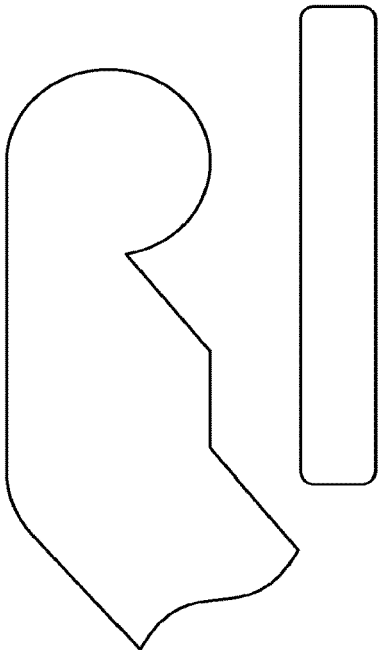
Figure 8I:
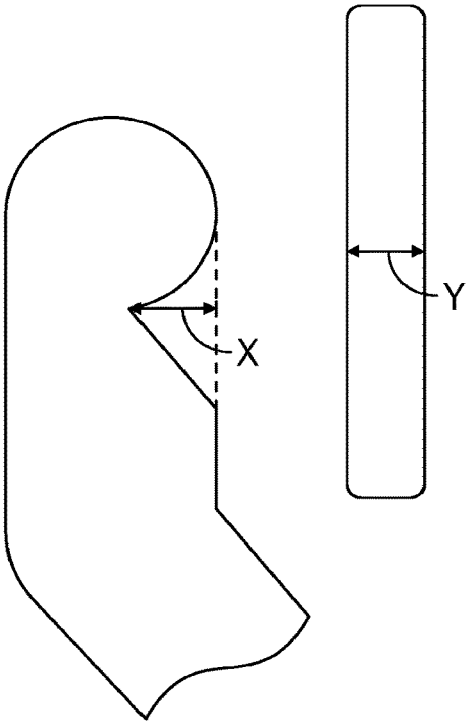
Figure 8J:
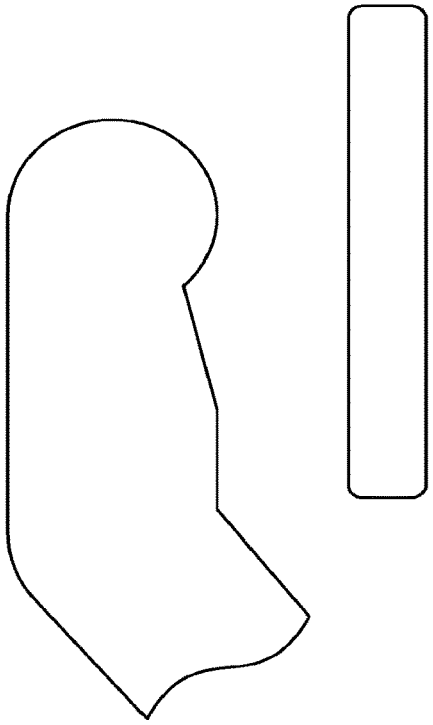
Figure 8K:
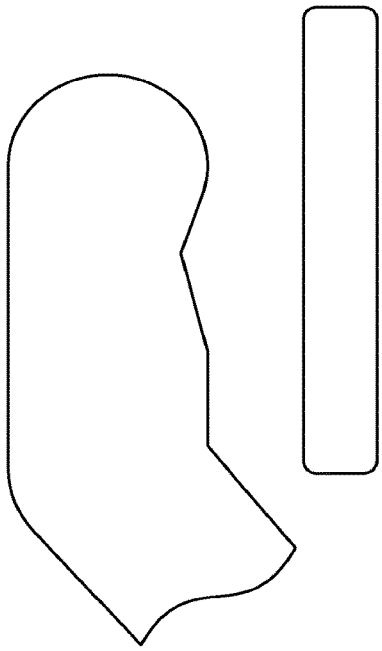
Figure 8L:
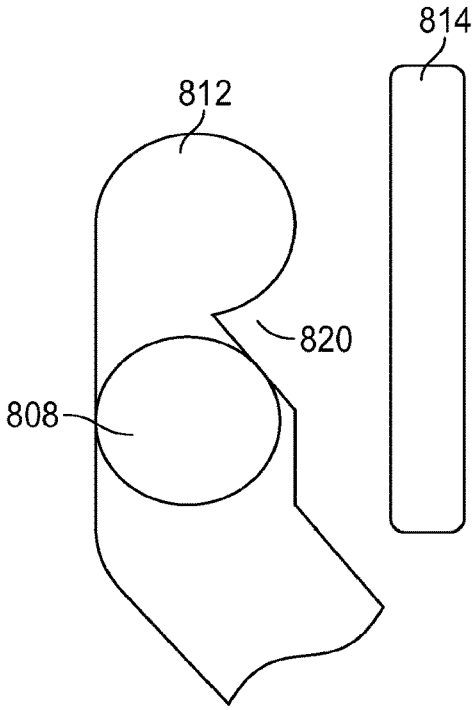
FIGS. 8L-8N illustrate an interaction between a receiving slot, a securing slot, a cam, and a tab of the embodiment of FIG. 8E.
Figure 8M:
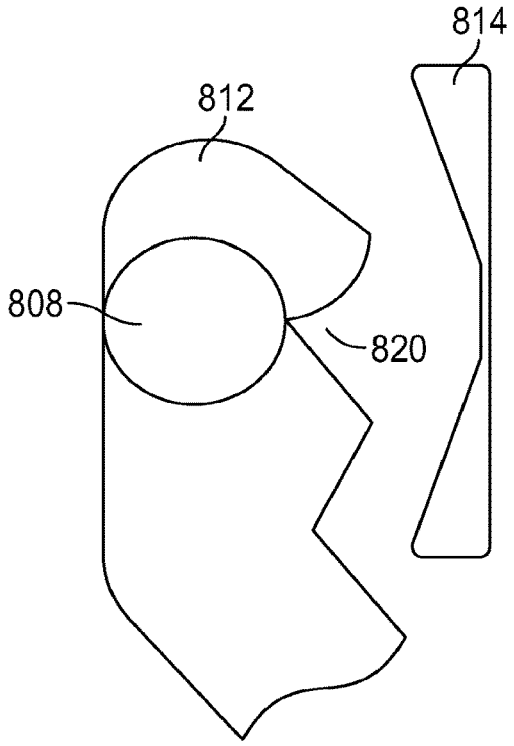
Figure 8N:
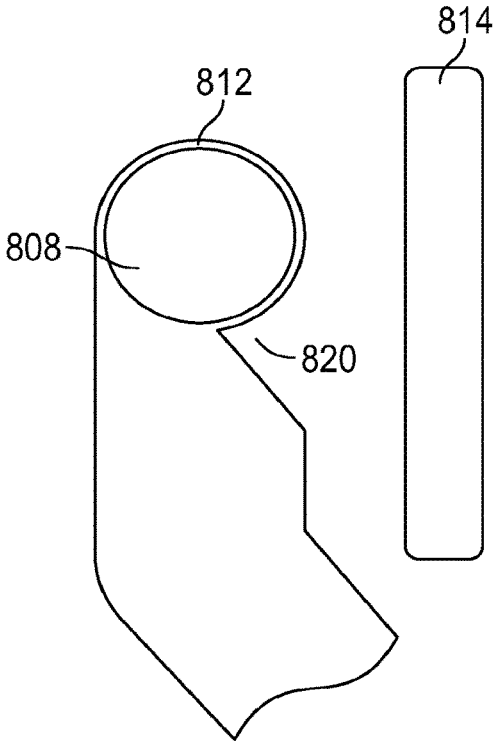
Figure 8O:
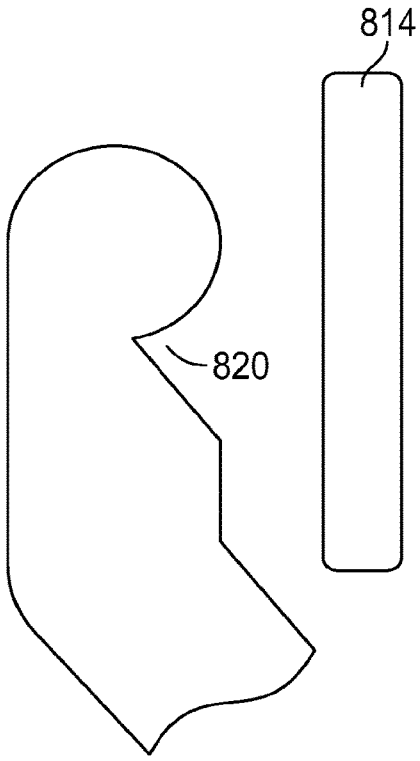
Figure 8P:
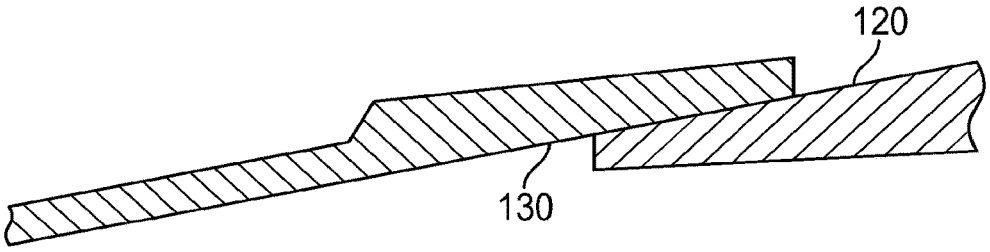
FIG. 8P illustrates tapers that may be employed across any of the embodiments of the present invention.

Referring specifically to FIGS. 8A-8O, apparatus 800 can include a first locking adapter 802 that can include a tab 808 and second locking adapter 804 that can include a receiving slot 810. The receiving slot 810 can include slot terminus 812 adapted to restrict rotational movement of the first locking adapter 802 relative to the second locking adapter 804. First adapter 802 and second adapter 804 can be coupled to conduit 806, for example (as shown in FIG. 8A), such that one end of conduit 806 is coupled to first adapter 802 and the other end of conduit 806 is coupled to second adapter 804. In other examples, First adapter 802 can be coupled to conduit 806 and second adapter 804 can be coupled to another vacuum component (not shown) in order to couple conduit 806 with the vacuum component in an airtight configuration.

In one example, first locking adapter 802 can be a male adapter adapted to couple or mate with second locking adapter 804 in a locking fashion. In this example, second locking adapter 804 can include a female adapted to receive the first locking adapter 802 such that the first and second adapters 802 and 804, respectively, by rotating one of the first and second locking adapters relative to the other such tab 808 is received by receiving slot 810.

Tab 808 can include any bump, protrusion, or the like extending away from an outer portion of first locking adapter 802. In one example, tab 808 can include a raised bump that extends 0.10 inches from the outer edge of first adapter 802, another other height clearances (e.g., less than or greater than 0.10 inches are contemplated as well). In other example, two or more tabs can be disposed along an outer edge of first adapter 802, either equally spaced or otherwise disposed around the perimeter of first adapter 802.

When first adapter 802 mates with second adapter 804 in a coupling fashion, tab 808 can be received by receiving slot 812 as shown, for example, in FIG. 8C thereby forming an airtight seal. Specifically, tab 808 can be received through receiving slot 812 and first and second locking adapters 802 and 804, respectively, are rotated relative to one another until tab 808 approaches slot terminus 812.

In one example, the rotation of first and second locking adapters 802 and 804, respectively, relative to the other can be approximately thirty (30) degrees, but other angles less than or greater than 30 are contemplated as well. The amount of rotation required to form an airtight seal can be a function—in part—on the angle receiving slot 810 is formed about second adapter 804. For example (as shown in FIG. 8C), angle Φ as measured along the perimeter of the outer edge of from the terminus 812 and its distal opposite end. The greater the angle Φ, the more rotation is required to couple first and second adapters 802 and 804, respectively. In this configuration, a friction taper fit can be accomplished between two or more vacuum elements to seal the same. Alternatively, the friction taper fit can be implemented to ensure a tight fit between components, relying on another sealing feature, as will be discussed below for an air/vacuum seal.

Additionally, slot 810 can be disposed at an angle Θ as measured orthogonally relative to angle Φ. In other words, this angle defines the final distance of terminus 812 relative to a terminal edge of second adapter 804. In the example illustrated in FIG. 8C, angle Θ is approximately 15 degrees although other angles are contemplated as well. The greater angle Θ defined, the greater second adapter 804 will overlap first adapter 802 when coupled together.

To further assist with the locking of first and second locking adapters 802 and 804, respectively, to one another, receiving slot 810 can ramped such that the height of the slot 810 relative to the second locking adapter 804 increases as the slot 810 approaches the slot terminus 812. Put another way, the portion of slot 810 nearest to slot terminus 812 can be designed to bow outwardly, thereby forcing portions of second adapter 804 adjacent the slot 810 toward tab 808 to further couple of first and second locking adapters 802 and 804, respectively, to one another. Receiving slot 810 can further include a flat portion to ensure a tighter fit between first and second adapters 802 and 804, respectively. To decouple first adapter 802 from second adapter 804, an operator can reverse the direction of rotation between the first adapter 802 from second adapter 804 to release tap 808 for receiving slot 810.

Referring specifically to FIGS. 8E and 8F, apparatus 800 can include all the features of apparatus 800 illustrated in FIGS. 8A-8D, with the addition of securing slot 814 and lip 816. Securing slot 814 can be adapted to secure the tab 808 within the slot terminus 812 such that a wall or portion 804*a* of second adapter 804 adjacent to the receiving slot 810 (and shown between the receiving slot 810 and the securing slot 814) is adapted to resiliently flex or deform, thereby locking the tab 808 to the receiving slot 810 when the tab 808 is coupled with the slot terminus 812.

Securing slot 814 can include any notch, cutaway, cavity, opening, or the like, disposed within, or removed from a part of, second adapter 804. For example, securing slot 814 can be formed within second adapter 804 at the time of its manufacturing, for example, through a molding process. Typically, second adapter 804, or just the portion 804*a* thereof, can be composed of one or more of plastics and/or other resilient-type materials. Because second adapter 804, or just the portion 804*a* thereof, can be formed out of resilient material, securing slot 814 allows the wall 804*a* of second adapter 804 to deform as tab 808 is moved along securing slot 814.

Through this deformation, the material of second adapter 804 between receiving slot 810 and securing slot 814 (e.g., portion 804*a*) can act as a spring, thus locking tab 808 in place within slot terminus 812. In other words, securing slot 814 can allow tab 808 to be locked in past a snap point of the receiving slot 810. Once second adapter 804 is decoupled from first adapter 802, portion 804*a* of second adapter 804 can return to its initial position by releasing the potential energy stored within the material by virtual of the deformation caused by tab 808 being disposed with in receiving slot 810. Portion 804*a* may include or produce a cam 815 to secure the tab in the slot terminus 812, preventing unintentional decoupling between the adapters 802,804, when the tab 808 is received within the slot terminus 812.

As shown in FIGS. 8E and 8F, the cam 215 may be formed by the portion 804*a* deforming into the securing slot, thereby locking the tab 808 is received within the slot terminus 812. Referring also to FIG. 8G, the cam 815 may comprise a raised portion 820 between the slot terminus 812 and the securing slot 814. As the tab 808 is moved past the raised portion 820 of the cam 815, the material between the slot terminus 812 and the securing slot 814 shifts, closing the securing slot 814, allowing the tab 808 to be firmly seated in the slot terminus 812. Once the tab 808 is firmly seated in the slot terminus 812, the material between the slot terminus 812 and the securing slot 814 rebounds, thereby securing the tab 808 in the slot terminus 812.

As better shown in FIG. 8H, the cam 815 can be shaped to tightly match the contour of the tab 808, in order to more securely hold the tab 808 in the slot terminus 812. As best shown in FIG. 8I, in at least one embodiment, the securing slot 814 is at least as wide as the cam 815, thus allowing the cam 815 to completely recess, clearing the path to the slot terminus 812 and allowing the tab 808 to pass by the cam 815 and seat within the slot terminus 812. As shown in FIGS. 8J and 8K, different shapes for the cam 815 are contemplated, such that the cam 815 need not be as pronounced, as is shown in FIG. 8I, in every embodiment. This variability is particularly useful when other securing techniques, such as that discussed below, are also employed. More specifically, the adapters 802 and 804 may also employ a taper or friction fit, or another technique, to secure them together, in which case the cam 815 need not provide all of the retaining force, and can thus be less pronounced, as shown in FIGS. 8J and 8K or even FIGS. 8E and 8F.

FIGS. 8G, 8L, 8M, and 8N show how the securing slot 814 and cam 815 function to secure the tab 808 within the slot terminus 812. Specifically, as shown in FIG. 8L, as the first adapter 802 is rotated with respect to the second adapter 804, the tab 808 traverses the receiving slot 810 towards the slot terminus 812. When the first adapter 802 is coupled (through thus rotation) with respect to the second adapter 804, the tab 808 engages the cam 815. Further rotation of the first adapter 802 with respect to the second adapter 804 causes the tab 808 to compress the cam 815, thereby collapsing the securing slot 814 through flexing of the portion 804*a*, as shown in FIG. 8M. Still further rotation of the first adapter 802 with respect to the second adapter 804 causes the tab 808 to pass the cam 815, which flexes back to secure the tab 808 within the slot terminus 812, FIG. 8N. In this position, the cam 815 prevents inadvertent counter-rotation of the first adapter 802 with respect to the second adapter 804, thereby holding the adapters 802 and 804 in a coupled relationship. In this manner, the interaction between the tab 808 and the cam 815, secure the adapters 802 and 804. Of course, should a user desire to uncouple the adapters 802 and 804, they need only counter-rotate the adapters, by intentionally applying torque, in which case a reverse process disengages the adapters 802 and 804.

To further assist the coupling of first adapter 802 to second adapter 804, first and second adapters can include one or more lips 816. Lips 816 can include shoulders or the like to facilitate an airtight, or merely wobble free, fit between these two adapters. For example, lip 816 on first adapter 802 can be raised 0.003 inches from the remaining portions for first adapter 802 (that can be configured dimensionally to be compatible with standard vacuum accessories, such as wands, tapered nozzles, or the like). Although lip 816 is described as being 0.003 inches in height, other dimensions greater than or less than 0.003 inches are contemplated as well. As second adapter 804 receives first adapter 802 around it, a terminal end of first adapter 802 can couple to the inner portion of second adapter 804 up to the point of lip 816. In this manner, the lip 816 provides a ring around the first adapter 802 that fits within the second adapter 804 to minimize play between the adapters 802,804 to that they do not wobble.

The friction taper fit and/or lip 816 discussed above may provide an air/vacuum seal between the adapters 802,804. Alternatively, the friction taper fit and/or lip 816, may only provide a secure connection preventing the adapters 802,804 from loosely wobbling with respect to one another, relying on a dedicated seal 818 for the air/vacuum seal between the adapters 802,804. The dedicated seal 818 may be, or be provided by, a gasket, o-ring, or a plastic member or feature of one or both of the adapters 802,804. It can be seen that one advantage of this configuration is that a user does not need to overcome friction of the seal when removing one adapter from the other, as could be the case for one or more of the earlier embodiments, depending on specific dimensions and tolerances.

For example, the male and female tapers 120 and 130 shown in various figures may be employed to entirely secure the adapters, such as adapters 802 and 804, to one another and/or entirely provide the airtight seal discussed herein. Forcing the male taper 120 into the female taper 130 tends to provide a friction fit which may secure the adapters to one another and/or provide an airtight seal. Alternatively, the tapers 120,130 may merely contribute to securing the adapters to one another and/or the airtight seal. Of course, other embodiments are envisioned with a combination of such features, such as, for example, where the tapers 120,130 contribute to, or entirely provide, the airtight seal but contribute little to securing the adapters together.

Many of the described features of the present invention can advantageously be combined. For example, as the first adapter 802 is rotated with respect to the second adapter 804, the tab 808 traverses the receiving slot 810 towards the slot terminus 812, as described above with respect to FIGS. 8L, 8M, and 8N. Referring also to FIGS. 8E and 8F, rotation of the first adapter 802 with respect to the second adapter 804, before the tab 808 engages the cam 815, causes the first adapter 802 to be drawn into the second adapter 804, by action of the tab 808 moving along the angled receiving slot 810. This is also described with respect to the tab of element 108 moving along the ramped first flange 102, as shown in FIGS. 3A, 3B, 3C, 4A, 4B, and 5, as well the securing element 452 moving along the ramped first flange 402 shown in FIGS. 6A and 6B. In an embodiment employing the tapers 120,130, the action of drawing the first adapter 802 into the second adapter 804 may induce a friction fit between the adapters. That friction fit may provide, or merely contribute to, securing the adapters to one another and/or the airtight seal.

Figure 9A:
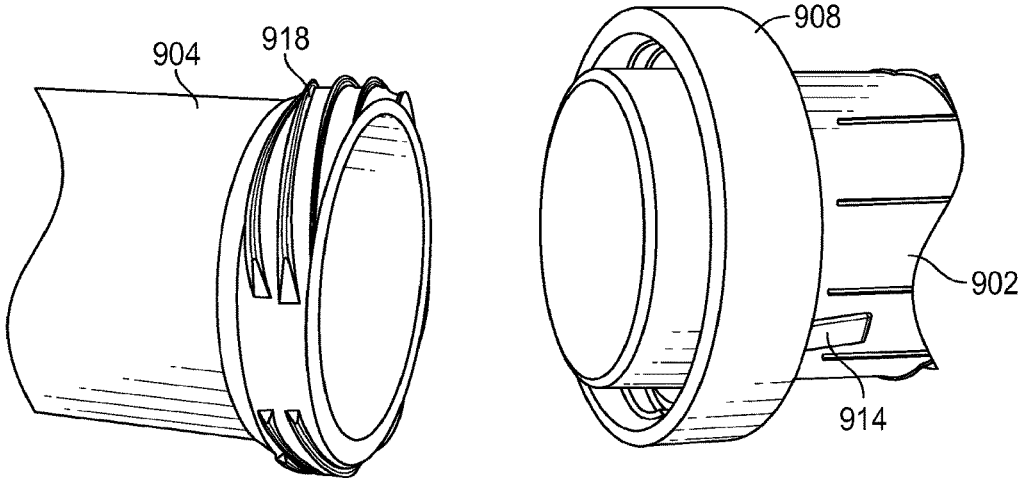
FIG. 9A illustrates a perspective view of a sixth embodiment of an apparatus for securing a vacuum hose or accessory to a vacuum device in a decoupled configuration.
Figure 9B:
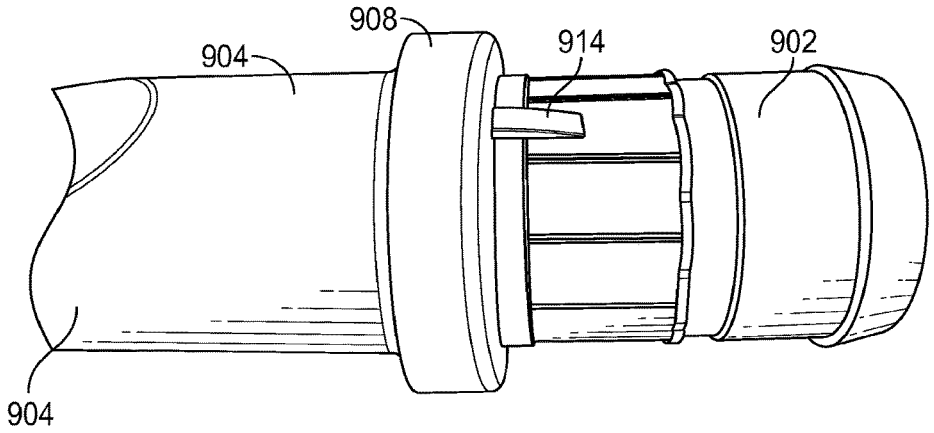
FIG. 9B illustrates a perspective view of the embodiment of FIG. 9A in a coupled configuration.
Figure 9C:
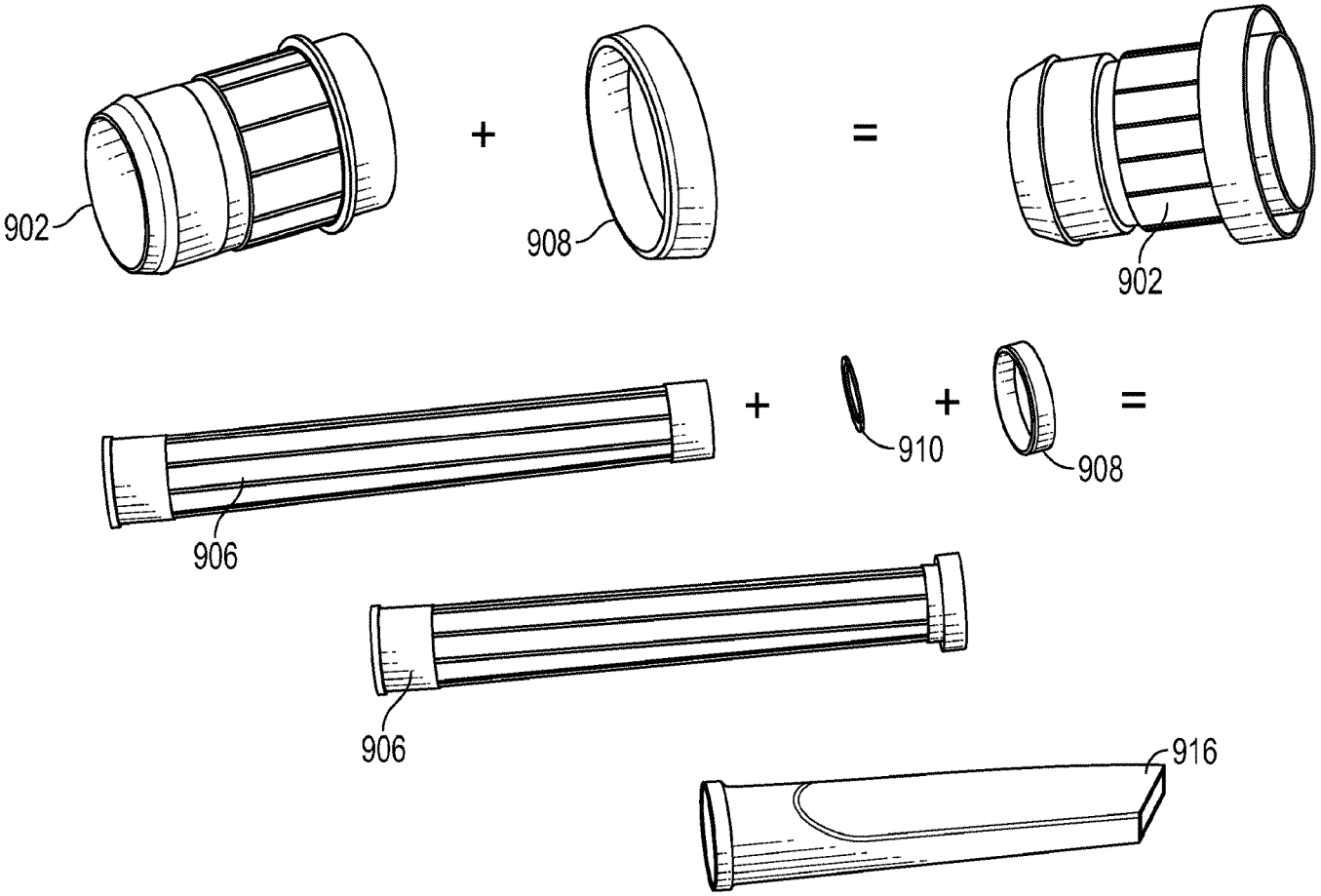
FIG. 9C illustrates a partially disassembled, environmental view of various components including the sixth embodiment of an apparatus for securing a vacuum hose or accessory to a vacuum device as illustrated in FIG. 9A.
Figure 9D:
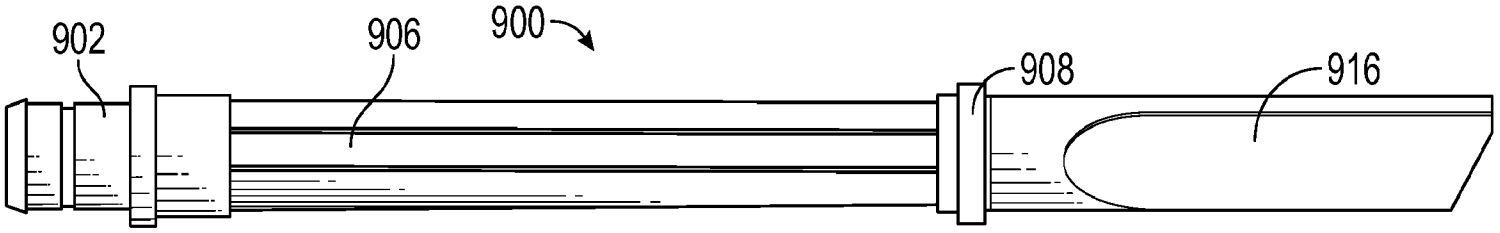
FIG. 9D illustrates an assembled, environmental view of the various components illustrated in FIG. 9C.

FIG. 9A illustrates a perspective view of a sixth embodiment of an apparatus for securing a vacuum hose or accessory to a vacuum device in a decoupled configuration. FIG. 9B illustrates a perspective view of the embodiment of FIG. 9A in a coupled configuration. FIG. 9C illustrates a partially disassembled, environmental view of various components including the sixth embodiment of an apparatus for securing a vacuum hose or accessory to a vacuum device as illustrated in FIG. 9A. FIG. 9D illustrates an assembled, environmental view of the various components illustrated in FIG. 9C. These figures will be described in conjunction with one another.

Referring specifically to FIGS. 9A and 9B, apparatus 900 can include a first locking adapter 902 and second locking adapter 904. For example, first locking adapter 902 can include a male-type adapter adapted to mate with second locking adapter 904 that can include a female-type adapter.

In the example illustrated in FIG. 9B, conduit 906 can be coupled to first adapter 902 with the aid of collar 908.

Collar 908 can be coupled to first adapter in various manners including snap-type configurations. Is this type of coupling, collar 908 can be coupled to decoupled from various vacuum components (such as accessory wands, nozzles, or the like). Collar 908 can be released from first adapter 902 (or alternatively, a vacuum accessory or the like) through the use of a tab 914. Tab 914 can include a spring-type or release-type tab for quickly removing collar 908.

Collar 908 can include threads (not shown) or the like for receiving the threads 918 of second adapter 904. In this configuration, as second adapter 904 is received by first adapter 902, second adapter 904 can be threaded into collar 908 of first adapter 902 to form an airtight coupling between the two. In order to release the first and second adapters 902 and 904, respectively, an operator can unthread the same by rotating these components in the opposition direction. In one example, first and second adapters 902 and 904, respectively, can be replaced with one or more vacuum components (such as hoses, wands, accessories, or the like) so that these components can be coupled though the thread-type coupling with the aid of collar 908 as described above.

Referring specifically to FIGS. 9C and 9D, vacuum appliance 916 can be coupled to conduit 906 with apparatus 900. Specifically, first adapter 902 can be coupled to collar 908 with a seal 910, such as a gasket, o-ring, or the like, to form an airtight seal between first adapter 902 and collar 908. Collar 908 can be coupled to vacuum accessory 916, such as a vacuum wand extension. In this configuration, various vacuum components such as hoses, wands, and the like can be quickly and easily coupled and decoupled from one another in accordance with the description above.

Figure 10:
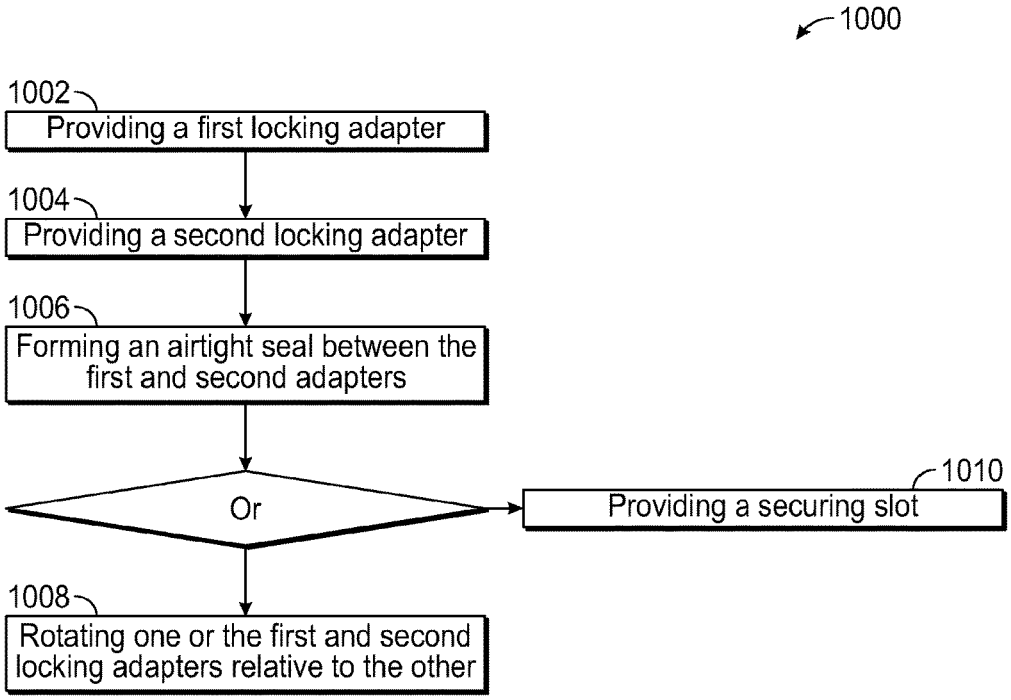
FIG. 10 illustrates a general flow diagram depicting a second embodiment of an exemplary method of using devices of the present invention.

FIG. 10 illustrates a general flow diagram depicting a second embodiment of an exemplary method of using devices of the present invention. The method 1000 for securing a vacuum appliance to a vacuum device that can include the step 1002 of providing a first locking adapter that can include a tab and the step 1004 of providing a second locking adapter that can include a receiving slot. Additionally, the method can include the step 1006 of forming an airtight seal between the first and second locking adapters when the tab is received by the receiving slot. Further, the method 1000 can include the step 1008 of rotating one or more of the first and second locking adapters relative to the other, for example, by rotating the locking adapters approximately thirty (30) degrees relative to each other and the step 1010 of providing a securing slot that can be adapted to secure the tab within a slot terminus.

Figure 11A:
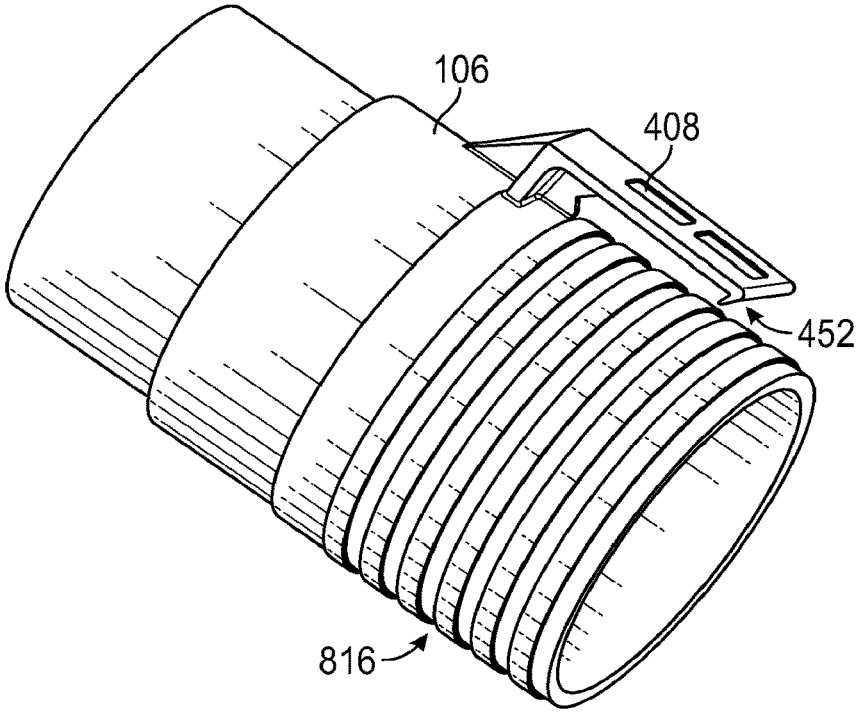
FIG. 11A illustrates a perspective view of a portion of a seventh embodiment of an apparatus for securing a vacuum hose or accessory to a vacuum device in a decoupled configuration.
Figure 11B:
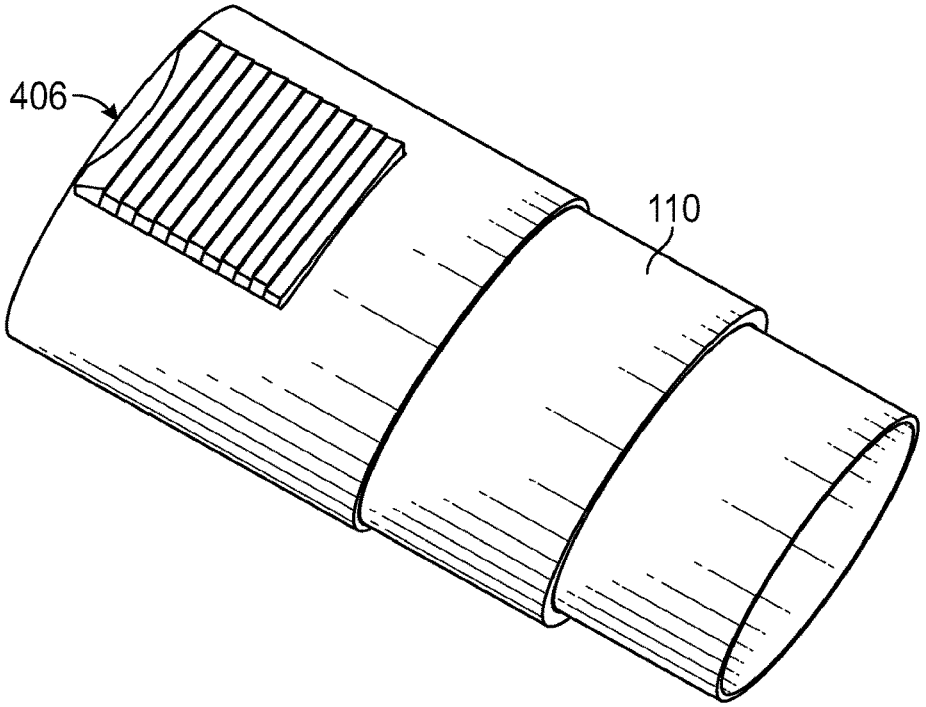
FIG. 11B illustrates a perspective view of a portion of the seventh embodiment of an apparatus for securing a vacuum hose or accessory to a vacuum device in a decoupled configuration, the portion being designed to couple with the portion shown in FIG. 11A in a coupled configuration.

FIGS. 11A and 11B illustrate a perspective view of portions of a seventh embodiment of an apparatus for securing a vacuum hose or accessory to a vacuum device in a decoupled configuration. A first conduit 106 can be coupled to a tab 408. The tab 408 may include a securing element 452. The tab 408 may include a release element and be similar to that shown and described above in connection with FIGS. 6A and 6B. In a preferred version of this embodiment, the securing element 452 includes an angled tooth, as shown in FIG. 11A. A securing adapter 110 of this embodiment preferably includes a series of substantially parallel flanges 406. The flanges 406 are preferable angled in complementary fashion to receive the angled tooth of the securing element 452.

In use, the first conduit 106 of this embodiment may be coupled to the securing adapter 110 of this embodiment by simply aligning them and pushing one within the other longitudinally. As the first conduit 106 slides within the securing adapter 110, the angled tooth of the securing element 452 consecutively engages each of the series of flanges 406, thereby coupling the first conduit 106 to the securing adapter 110, until sufficient resistance it met and/or any airtight seal is formed between the first conduit 106 slides and the securing adapter 110.

It should be noted that, in order to form the airtight seal, the tooth may not be required to engage every one of the series of flanges 406. This is particularly so, when the system is new. As the system is used, components may wear. As such, the series of flanges 406 may include more flanges than is required to form the airtight seal, particularly when the system is new. These extra flanges may be used as the system wears with use, thereby ensuring the operator can form a reliable airtight seal through the expected useful life of the system.

The first conduit 106 of this embodiment may be decoupled from the securing adapter 110 of this embodiment in any manner described above, such as that shown in FIG. 6B. Alternatively, or additionally, the first conduit 106 may be decoupled from the securing adapter 110 be simply rotating the first conduit 106 with respect to the securing adapter 110 until the angled tooth of the securing element 452 disengages from the flanges 406, thereby allowing the first conduit 106 to be pulled from the securing adapter 110.

As shown in FIG. 11A, the first conduit 106 may include one or more lips 816. Lips 816 can include shoulders or the like to facilitate an airtight, or merely wobble free, fit between the first conduit 106 and the securing adapter 110. The lips 816 may comprise a series of tapered sealing areas to minimize friction between the first conduit 106 and the securing adapter 110 while providing an airtight seal. Each lip 816 may be, or be provided by, a gasket, o-ring, or a plastic member or feature of the first conduit 106. It can be seen that one advantage of this configuration is that a user does not need to overcome friction of the seal when coupling and decoupling the first conduit 106 and the securing adapter 110.

In one embodiment, the elements described throughout this application can be designed to be compatible with preexisting or standardized vacuum device fittings. For example, the inner and outer diameters of the securing apparatus 100 (as shown in FIG. 2) can be formed with the same dimensions as a standard female end of a vacuum appliance wand. In other words, the components described throughout the written description can be employed to replace preexisting vacuum components currently available on the market. The elements described throughout this application may also be interchanged between the described embodiments. Furthermore, the elements described throughout can be formed of materials including, but not limited to, injection-molded plastic, such as polypropylene, polyethylene, ABS, thermoplastics, polymerizing resin, polyacetal, polystyrene, and/or similar materials, with or without filling additives like fibers, chalks, or other flowable and settlable materials that may be injection-molded, cast, or low-pressure molded, in accordance with conventional practice.

The term "substantially parallel," as used throughout the disclosure, can be defined as an angle that deviates no more than ten degrees from a parallel configuration. For example (referring to FIG. 3B), if the first flange 102 is disposed at an angle Φ of thirty (30) degrees, the second flange 104 is substantially parallel with the first flange 102 if it disposed at an angle Φ between twenty (20) and forty (40) degrees (inclusive). Furthermore, a substantially parallel angle may include a parallel angle.

The term "approximately," as used throughout the disclosure to describe an angle, can be defined as an angle that deviates no more than ten (10) degrees from a the specified angle. For example (referring to FIG. 8C), if the slot 810 is disposed at an angle Φ of approximately thirty (30) degrees, slot 810 can vary from an angle Φ between twenty (20) and forty (40) degrees (inclusive). Furthermore, an "approximate" angle can equal the identified angle as well such that, for example, an angle of "approximately" thirty (30) degrees can include thirty (30) degrees.

The term "coupled," "coupling," "coupler," and like terms are used broadly herein and can include any method or device for securing, binding, bonding, fastening, attaching, joining, inserting therein, forming thereon or therein, or otherwise associating, for example, mechanically, magnetically, electrically, chemically, operably, directly or indirectly with intermediate elements, one or more pieces of members together and can further include without limitation integrally forming one functional member with another in a unitary fashion. The coupling can occur in any direction, including rotationally.

Particular embodiments of the invention may be described with reference to block diagrams and/or operational illustrations of methods. In some alternate implementations, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved.

Other and further embodiments utilizing one or more aspects of the inventions described above can be devised without departing from the spirit of Applicant's invention. It should be appreciated by those of skill in the art that the techniques disclosed in the disclosed embodiments represent techniques discovered by the inventor(s) to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the scope of the invention.

In some alternate implementations, the functions/actions/structures noted in the figures can occur out of the order noted in the block diagrams and/or operational illustrations. For example, two operations shown as occurring in succession, in fact, can be executed substantially concurrently or the operations can be executed in the reverse order, depending upon the functionality/acts/structure involved. For example, FIG. 7 illustrates one possible embodiment of a method for securing a vacuum appliance to a vacuum device. More specifically, FIG. 7 recites the step 702 of providing a securing adapter for a vacuum device. Further, FIG. 7 recites the step 704 of providing a securing mechanism. Other embodiments can include performing step 704 before step 702. In some embodiments, some steps can be omitted altogether. Therefore, though not explicitly illustrated in the figures, any and all combinations or subcombinations of the steps illustrated in FIG. 7, or additional steps described in the figures or the detailed description provided herein, can be performed in any order, with or without regard for performing the other recited steps.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. An apparatus for securing a vacuum appliance to a vacuum device, the apparatus comprising:

a first locking adapter, wherein the first locking adapter comprises a tab; and a second locking adapter, wherein the second locking adapter comprises a receiving slot and an adjacent securing slot, with a flexible wall therebetween;

wherein the first and second locking adapters form an airtight seal when the tab is received by the receiving slot.

2. The apparatus according to claim 1, wherein the wall of the second adapter is adapted to resiliently flex or deform, thereby locking the tab in the receiving slot.

3. The apparatus according to claim 1, wherein the receiving slot comprises a slot terminus, wherein the terminus is adapted to restrict rotational movement of the first locking adapter relative to the second locking adapter.

4. The apparatus according to claim 1, wherein the first and second locking adapters are rotated at least thirty (30) degrees relative to one another to form the airtight seal.

5. The apparatus according to claim 1, wherein the receiving slot comprises a slot terminus adjacent the wall, such that the wall of the second adapter is adapted to resiliently deform, thereby locking the tab to the slot terminus.

6. The apparatus according to claim 5, wherein the receiving slot is ramped such that the second locking adapter is drawn into the first locking adapter as the tab approaches the slot terminus.

7. The apparatus according to claim 5, wherein the wall includes a cam that protrudes into the receiving slot, thereby locking the tab to the slot terminus.

8. A method for securing a vacuum appliance to a vacuum device, the method comprising:

providing a first locking adapter, wherein the first locking adapter comprises a tab;

providing a second locking adapter, wherein the second locking adapter comprises a receiving slot and an adjacent securing slot, with a flexible wall therebetween; and forming an airtight seal between the first and second adapters when the tab is received by the receiving slot.

9. The method according to claim 8 wherein the step of forming an airtight seal comprises rotating one of the first and second locking adapters relative to the other, such that the tab moves along the receiving slot and deforms the wall, thereby locking the tab within the receiving slot.

10. The method according to claim 8, wherein the receiving slot comprises a slot terminus adjacent the wall, such that the wall of the second adapter is adapted to resiliently deform, thereby locking the tab to the slot terminus.

11. The method according to claim 10 wherein the receiving slot is ramped such that the second locking adapter is drawn into the first locking adapter as the tab approaches the slot terminus.

12. The method according to claim 10, wherein the wall includes a cam that protrudes into the receiving slot, thereby locking the tab to the slot terminus.

13. The method according to claim 8, wherein the first and second locking adapters are rotated at least thirty (30) degrees relative to one another to form the airtight seal.

14. A system for securing a vacuum appliance, the system comprising:

a vacuum device; and an apparatus for securing the vacuum appliance, the apparatus comprising:

a first locking adapter, wherein the first locking adapter comprises a tab; and a second locking adapter, wherein the second locking adapter comprises a receiving slot and an adjacent securing slot, with a flexible wall therebetween;

wherein the first and second locking adapters form an airtight seal when the tab is received by the receiving slot.

15. The system according to claim 14, wherein the wall of the second adapter is adapted to resiliently flex or deform, thereby locking the tab in the receiving slot.

16. The system according to claim 14, wherein the receiving slot comprises a slot terminus, wherein the terminus is adapted to restrict rotational movement of the first locking adapter relative to the second locking adapter.

17. The system according to claim 14, wherein the first and second locking adapters are rotated at least thirty (30) degrees relative to one another to form the airtight seal.

18. The system according to claim 14, wherein the receiving slot comprises a slot terminus adjacent the wall, such that the wall of the second adapter is adapted to resiliently deform, thereby locking the tab to the slot terminus.

19. The system according to claim 18, wherein the receiving slot is ramped such that the second locking adapter is drawn into the first locking adapter as the tab approaches the slot terminus.

20. The system according to claim 18, wherein the wall includes a cam that protrudes into the receiving slot, thereby locking the tab to the slot terminus.

* * * * *